US007293297B2

(12) United States Patent
Hayashi et al.

(10) Patent No.: US 7,293,297 B2
(45) Date of Patent: Nov. 13, 2007

(54) AUTOMATIC TOILET SEAT OR TOILET COVER LIFTING AND LOWERING DEVICE

(75) Inventors: Ryosuke Hayashi, Fukuoka (JP); Yoshiro Terada, Fukuoka (JP); Hiroomi Miyamoto, Fukuoka (JP); Kenji Hashidume, Fukuoka (JP)

(73) Assignee: Toto, Ltd., Fukuoka (JP)

( * ) Notice: Subject to any disclaimer, the term of this patent is extended or adjusted under 35 U.S.C. 154(b) by 362 days.

(21) Appl. No.: 10/503,086

(22) PCT Filed: Feb. 10, 2003

(86) PCT No.: PCT/JP03/01357

§ 371 (c)(1),
(2), (4) Date: Jul. 30, 2004

(87) PCT Pub. No.: WO03/065866

PCT Pub. Date: Aug. 14, 2003

(65) Prior Publication Data

US 2005/0217010 A1 Oct. 6, 2005

(30) Foreign Application Priority Data

Feb. 8, 2002 (JP) ..... 2002-033244
Mar. 26, 2002 (JP) ..... 2002-085526
Nov. 6, 2002 (JP) ..... 2002-322990

(51) Int. Cl.
*A47K 13/10* (2006.01)

(52) U.S. Cl. ..... 4/246.1

(58) Field of Classification Search ..... 4/246.1–246.5
See application file for complete search history.

(56) References Cited

U.S. PATENT DOCUMENTS 4,975,988 A * 12/1990 Won ..... 4/246.3

(Continued)

FOREIGN PATENT DOCUMENTS

JP 1-207023 8/1989

(Continued)

OTHER PUBLICATIONS

Microfilm of the specification and drawings annexed to the request of Japanese Utility Model Application No. 33984/1988 (Laid-open No. 141594/1989) (Matsushita Electric Works, Ltd.), Sep. 28, 1989, claims; p. 6, lines 3 to 20; Fig. 2.

(Continued)

*Primary Examiner*—Huyen Le
(74) *Attorney, Agent, or Firm*—Wenderoth, Lind & Ponack, L.L.P.

(57) ABSTRACT

An automatic lifting and lowering device for a toilet seat or a toilet cover usable for a toilet seat provided with a function of washing a body with hot water, which requires reduced size and weight, includes a rotating shaft (40) rotated together with the toilet seat or the toilet cover, a drive motor (32) rotating the rotating shaft (40) in normal and reverse directions, and a speed reduction gear train (33). The drive force of the drive motor (32) is transmitted to the rotating shaft (40) through the speed reduction gear train (33) to automatically lift and lower the toilet seat or toilet cover, whereby the automatic lifting and lowering device itself can be formed compact by using a planetary gear mechanism for the speed reduction gear train (33).

4 Claims, 26 Drawing Sheets

U.S. PATENT DOCUMENTS 5,444,877 A * 8/1995 Kumarasurier ..... 4/246.1

FOREIGN PATENT DOCUMENTS

| | | |
|---|---|---|
| JP | 1-303114 | 12/1989 |
| JP | 3-9708 | 1/1991 |
| JP | 3003739 | 8/1994 |
| JP | 6-84692 | 4/1996 |
| JP | 9-313404 | 12/1997 |
| JP | 11-216083 | 8/1999 |
| JP | 2000-41899 | 2/2000 |
| JP | 2000-51122 | 2/2000 |

OTHER PUBLICATIONS

Microfilm of the specification and drawings annexed to the request of Japanese Utility Model Application No. 32279/1986 (Laid-open No. 143948/1987) (Kabushiki Kaisha Oi Seisakusho.), Sep. 10, 1987, claims; p. 5, line 15 to p. 6, line 6; Figs. 1, 5.

* cited by examiner

AUTOMATIC TOILET SEAT OR TOILET COVER LIFTING AND LOWERING DEVICE

TECHNICAL FIELD

The present invention relates to an automatic lifting and lowering device for a toilet seat or a toilet cover of a Western-style toilet, and more specifically, the present invention relates to a device that automatically lifts and lowers the toilet seat or the toilet cover on an individual basis.

BACKGROUND ART

As for an automatic lifting and lowering device for a toilet seat or a toilet cover of a Western-style toilet, a technology disclosed in Unexamined Japanese Patent Publication No. Hei 11-216083 is known, in which each of the toilet seat and the toilet cover is provided with the separate automatic lifting and lowering device. In the automatic lifting and lowering device, an output shaft of a drive motor is coupled with a rotating shaft thereof through a plurality of gear trains so that the output shaft and the rotating shaft are formed nonconcentrically from each other.

The foregoing device requires a large attachment area (with respect to a plane of projection orthogonal to the center of the rotating shaft) because the device has the plurality of gear trains each of which has a different shaft. Thus, the device is inconvenient to use in a toilet seat provided with a function of washing a body with hot water or the like, which is required to be reduced in size and weight.

Considering the foregoing conventional problem, an object of the present invention is to reduce the size, weight, and the like of each of an automatic lifting and lowering device for a toilet seat and an automatic lifting and lowering device for a toilet cover.

SUMMARY OF THE INVENTION

In a first aspect of the invention, an automatic toilet seat or toilet cover lifting and lowering device comprises a rotating shaft rotated together with a toilet seat or a toilet cover, and a drive motor for rotating the rotating shaft in normal and reverse directions, wherein a drive force of the motor is transmitted to the rotating shaft through a speed reduction gear train to automatically lift and lower the toilet seat or the toilet cover. A planetary gear mechanism is used as the speed reduction gear train so that the drive motor, the speed reduction gear train, and the rotating shaft can be concentrically disposed. The outside shape of the whole device is a circle concentric with the rotating shaft with respect to a plane of projection orthogonal to the center of the rotating shaft. Therefore, since the automatic lifting and lowering device is easily compatible with a loose lowering unit and the like, housing design becomes extremely easy.

In a second aspect of the invention, in addition to the configuration according to the first aspect of the invention, the planetary gear mechanisms are disposed in a plurality of stages in series. Therefore, it is possible to use a relatively small motor and planetary gear mechanisms, and hence the design for housing becomes further easier.

In a third aspect of the invention, in addition to the first and second aspects of the invention, a torque limiter mechanism is provided between an output shaft of the planetary gear mechanism in a final stage and the rotating shaft. Even if an excessive load is applied to the rotating shaft in such cases that the toilet seat or the toilet cover is manually held during automatic lifting and lowering operations, the excessive load at the rotating shaft side is not applied to the planetary gear mechanisms. Therefore, it is possible to prevent the breakage of the device itself.

In a fourth aspect of the invention, in addition to the first, second and third aspects of the invention, position detection means, which outputs positional information corresponding to an lifting and lowering state, is provided between the output shaft of the planetary gear mechanism in a final stage and the rotating shaft. Thus, even if a cog of the gear is chipped, for example, the lifting and lowering position of the toilet seat or cover does not deviate. Therefore, it is possible to realize a stable operation.

In a fifth aspect of the invention, an automatic toilet seat or toilet cover lifting and lowering device comprises a rotating shaft rotated together with a toilet seat or a toilet cover, and a drive motor for rotating the rotating shaft in normal and reverse directions, wherein a drive force of the motor is transmitted to the rotating shaft through a speed reduction gear train to lift and lower the toilet seat or the toilet cover. A planetary gear mechanism is used in a final stage of the speed reduction gear train. Since the final gear, which needs the highest strength, is composed of a plurality of planetary gears, it is possible to disperse the drive force to be received. Accordingly, sufficient strength is obtained even if the speed reduction gear is small, and the planetary gear mechanism has a large speed reduction ratio as compared with a spur gear or the like so that it is possible to miniaturize the automatic lifting and lowering device itself.

In a sixth aspect of the invention, in addition to the fifth aspect of the invention, according to claim 26, the planetary gear mechanism and the drive motor are adjacently disposed in such a manner that an input end face of the planetary gear mechanism and an output end face of the drive motor are approximately coplanar. At the same time, the center of the shaft of the remaining speed reduction gear train is disposed inside an area that is surrounded by two circles formed on a plane of projection of the planetary gear mechanism and the drive motor and inside lines circumscribing the two circles. Thus, a pinion provided in the output shaft of the drive motor and a gearwheel integrally provided in a sun gear of the planetary gear mechanism are disposed in a coplanar manner. Therefore, it is possible to configure the automatic lifting and lowering device with the depth in which thickness of one of a gearwheel and a pinion of the speed reduction gear train, which couples the output shaft of the drive motor to an input shaft of the planetary gear mechanism, is added to thicker depth between the depth of the motor and the depth of the planetary gear mechanism. The center of the shaft of the speed reduction gear train, which couples the output shaft of the drive motor to the input shaft of the planetary gear mechanism, is disposed inside the area that is surrounded by the two circles formed on the plane of projection of the planetary gear mechanism and the drive motor and inside the lines circumscribing the two circles. Thus, the remaining speed reduction gear train is disposed with effectively taking advantage of the plane of projection formed by the drive motor and the planetary gear mechanism. Therefore, it is possible to miniaturize the automatic lifting and lowering device itself.

In a seventh aspect of the invention, in addition to the sixth aspect of the invention, the center of the shaft of the remaining speed reduction gear train is disposed in an area that is surrounded by a horizontal line passing through the center of a sun gear of the planetary gear mechanism and the lines circumscribing the two circles. Therefore, it is possible to contain almost the whole height of the speed reduction gear train within the plane of projection of the drive motor and the planetary gear mechanism.

In an eighth aspect the invention, in addition to the sixth aspect of the invention, the center of the shaft of the remaining speed reduction gear train is disposed in an area that is surrounded by perpendicular lines which are perpendicular to a line connecting the center of the sun gear of the planetary gear mechanism and the center of the output shaft of the drive motor and pass through the centers thereof, and the lines circumscribing the two circles.

Therefore, even in a case where the drive motor and the planetary gear mechanism are not disposed perpendicularly to each other, optimal design is carried out so that it is possible to provide the compact automatic lifting and lowering device. In a ninth aspect of the invention, an automatic toilet seat or toilet cover lifting and lowering device comprises a rotating shaft rotated together with a toilet seat or a toilet cover, and a drive motor for rotating the rotating shaft in normal and reverse directions, wherein a drive force of the motor is transmitted to the rotating shaft through a speed reduction gear train to lift and lower the toilet seat or the toilet cover. A thin portion is formed in an end portion of a motor output shaft which protrudes from the drive motor so that the end portion of the motor output shaft has a smaller diameter than that of the shaft inside the motor, and the thin portion is provided with a pinion. Since the pinion is provided at the thin portion, it is possible to miniaturize the pinion while maintaining the stable rotation of the motor as usual so that the number of cogs of the pinion is reduced. In this case, since a large speed reduction ratio can be obtained from the first stage of the speed reduction gear train, it is possible to miniaturize the automatic lifting and lowering device.

In a tenth aspect of the invention, in addition to the ninth aspect of the invention, a helical gear is used as the pinion. The helical gear is thinner than a spur gear, but can secure more contact area. Using the helical gear makes it possible to reduce the thickness of the gear itself while securing the strength of the gear so that the speed reduction gear train is made compact. Therefore, it is possible to miniaturize the automatic lifting and lowering device.

DETAILED DESCRIPTION OF PREFERRED EMBODIMENTS

The present invention will be described in detail with reference to the accompanying drawings.

Figure 1:
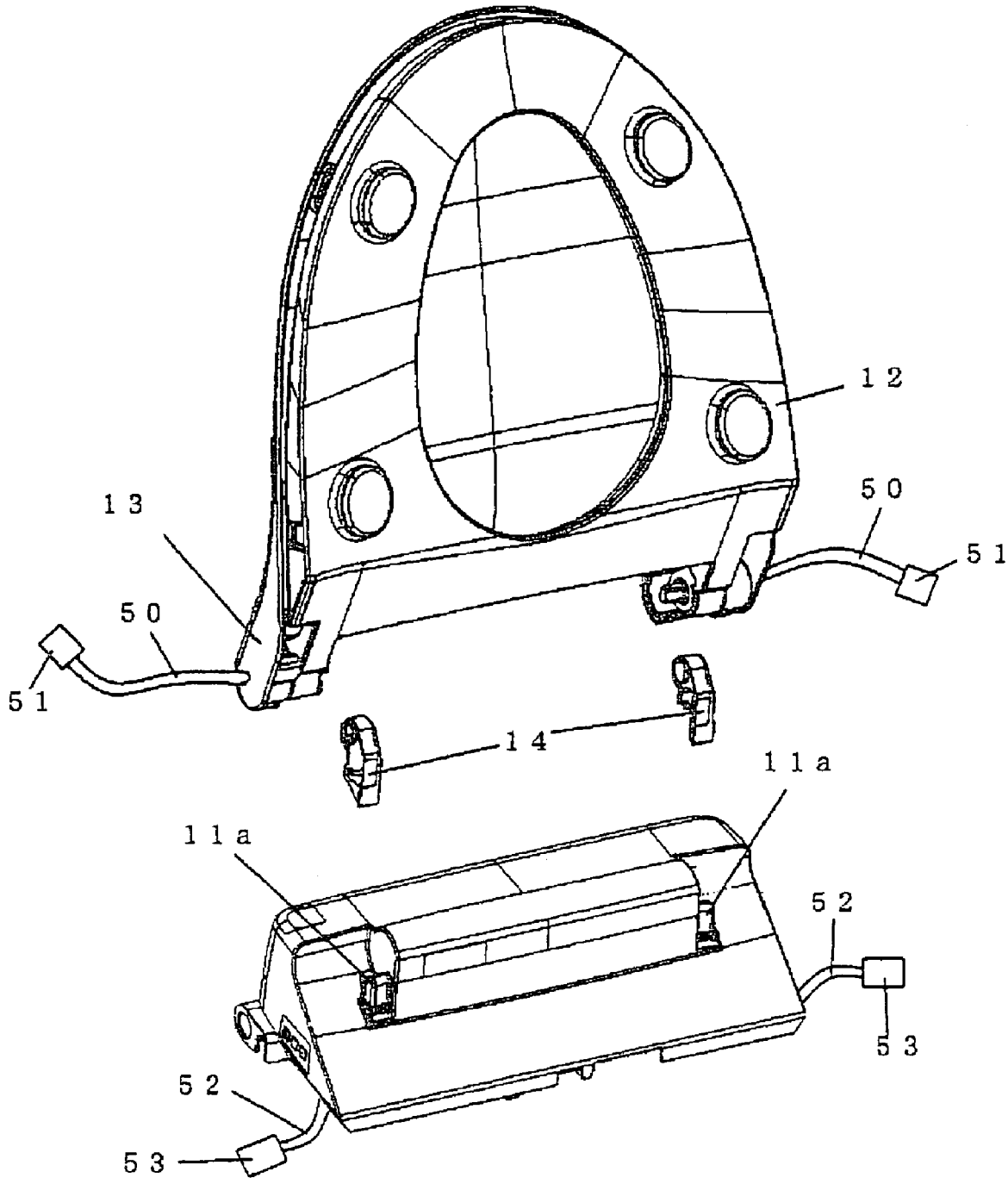
FIG. 1 is an exploded perspective view of a toilet system provided with a body washing function, in which an automatic lifting and lowering device according to the present invention is installed.

FIG. 1 is a perspective view of a toilet seat apparatus according to the present invention. In the drawing, a casing of a hot toilet seat apparatus is fixed by making use of the top face of a rim on the side of the back of a toilet main body (not illustrated). A toilet seat 12 and a toilet cover 13 are attached to the casing so that the toilet seat 12 and the toilet cover 13 can be independently lifted and lowered.

Each base end portion of the toilet seat 12 is provided with a rotating block insertion portion 12*a*, and each base end portion of the toilet cover 13 is provided with a rotating block insertion portion 13*a*.

An automatic lifting and lowering device 30 (details will be described later) for automatically lifting and lowering the toilet seat 12 and the toilet cover 13 is inserted in the rotating block insertion portions 12*a* and 13*a*. For convenience of explanation, the coupling relation on the right side of the drawing among the toilet seat 12, the automatic lifting and lowering device 30, and the casing will be hereinafter described, but the coupling relation on the left side among the toilet cover 13, the automatic lifting and lowering device 30, and the casing also has a similar structure thereto. (In the case of the toilet cover, components of the toilet seat hereinafter described are replaced with those of the toilet cover.)

A functional parts storage tube 31 of the automatic lifting and lowering device 30 is inserted into the rotating block insertion portions 12*a* and 13*a* in such a manner as to be unrotatable with respect to the block insertion portion 12*a* (A fixing block 31*a* fitted on the outer periphery of the functional parts storage tube 31 provides an orientation to the functional parts storage tube 31. Furthermore an inserted portion in approximately the same shape as the outside shape of the fixing block 31*a* is provided in the insertion portion 12*a* to make the functional parts storage tube 31 unrotatable), but to be rotatable with respect to the block insertion portion 13*a*. A rotating shaft 40 protruding from the automatic lifting and lowering device 30 is unrotatably inserted and fixed into a hinge shaft insertion portion 14*c* of a support block 14. The functional parts storage tube 31, however, is rotatable with respect to the rotating shaft 40 so that the toilet seat 12 and the toilet cover 13 operate rotatably with respect to the casing.

Projecting portions 11*a*, which are inserted into the support blocks 14, are formed in the front face of the casing, and an insertion hole 14*a* is formed in the bottom of the support block 14. Thus, the projecting portions 11*a* are inserted into the support blocks 14. A mechanism disclosed in Unexamined Japanese Patent Publication No. Hei 10-258003 in detail is available as an attachment and detachment mechanism between the support block 14 and the projecting portion 11*a*.

Figure 2:
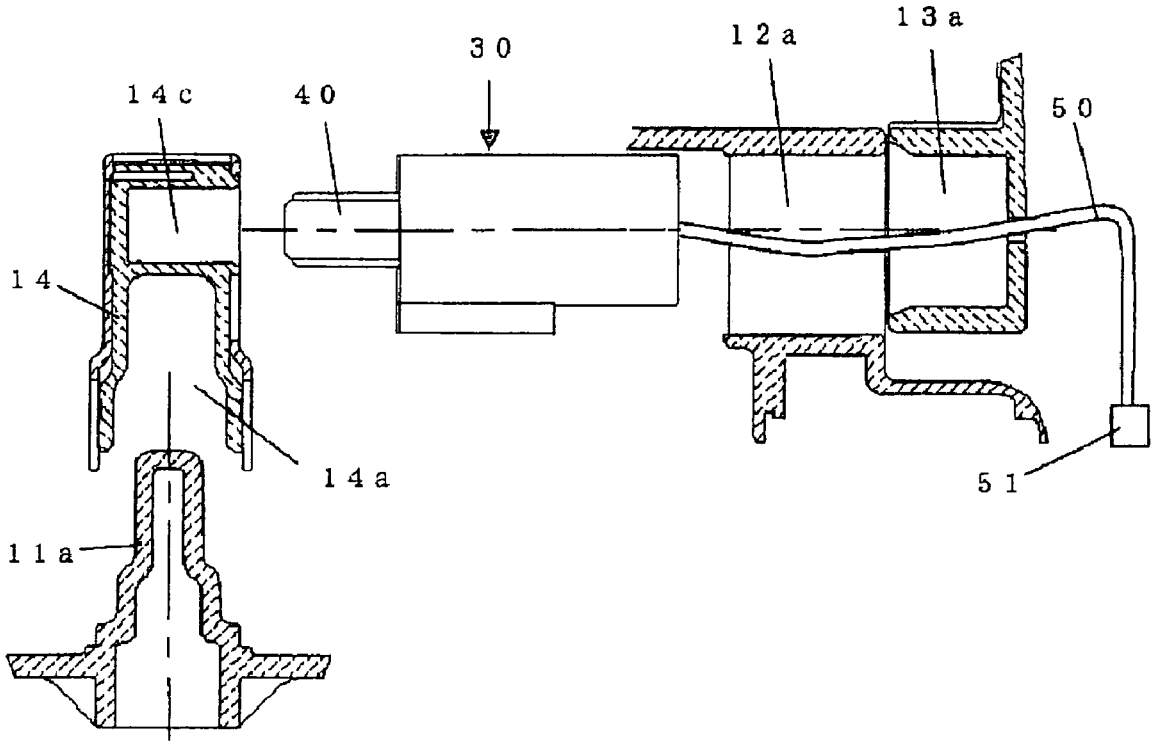
FIG. 2 is a sectional view for explaining how to attach a toilet seat of the toilet system with a body washing function, in which the automatic lifting and lowering device according to the present invention is installed, to a toilet, where a detachment state is shown.
Figure 3:
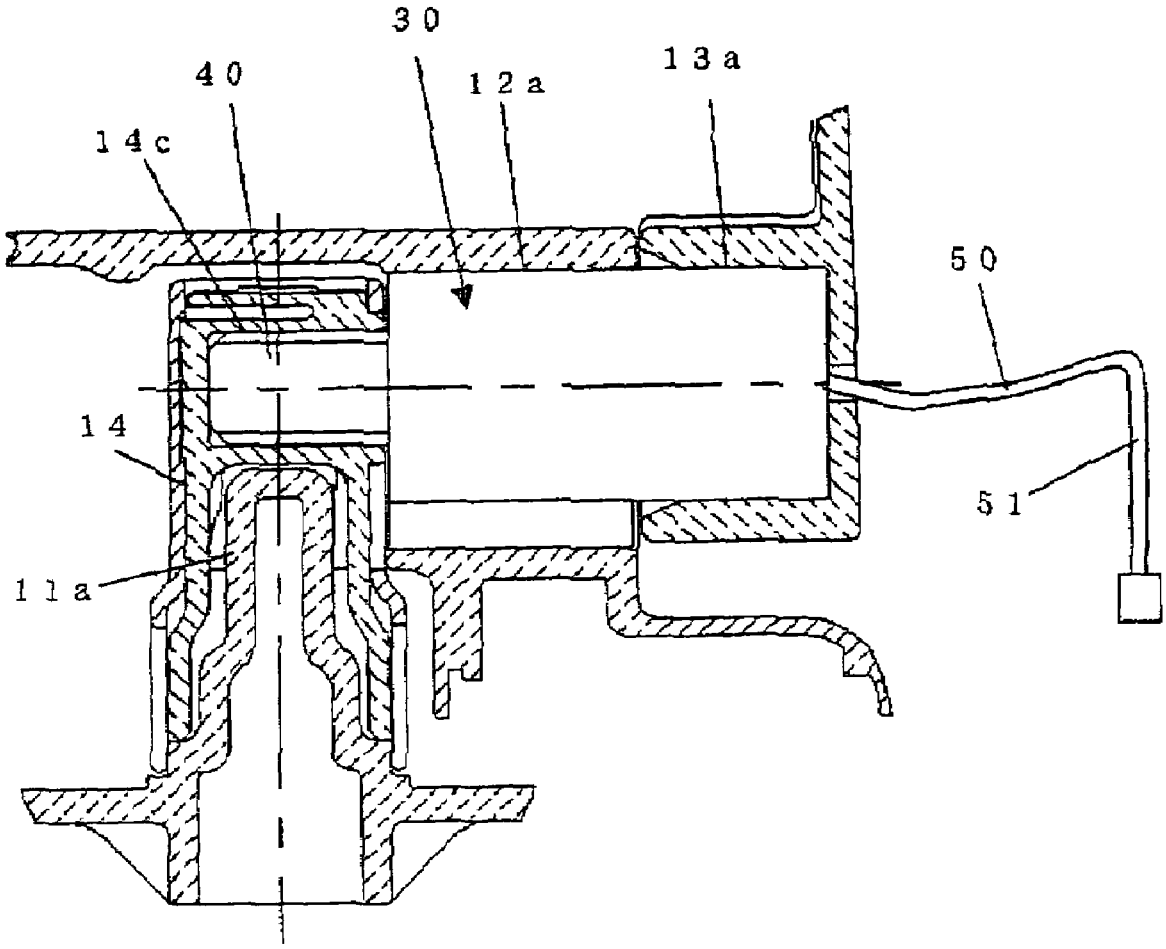
FIG. 3 is a sectional view for explaining how to attach a toilet seat of the toilet system with a body washing function, in which the automatic lifting and lowering device according to the present invention is installed, to the toilet, where an attachment state is shown.

As shown in FIG. 2 or FIG. 3, an electric wire 50, in which electric power lines and signal lines are bound, is drawn out of an end of the functional parts storage unit 31. A connector 51 is provided at an end of the electric wire 50. The connector 51 is connected to a connector 53, which is provided at an end of an electric wire 52 drawn out of a controller in the casing.

Figure 4:
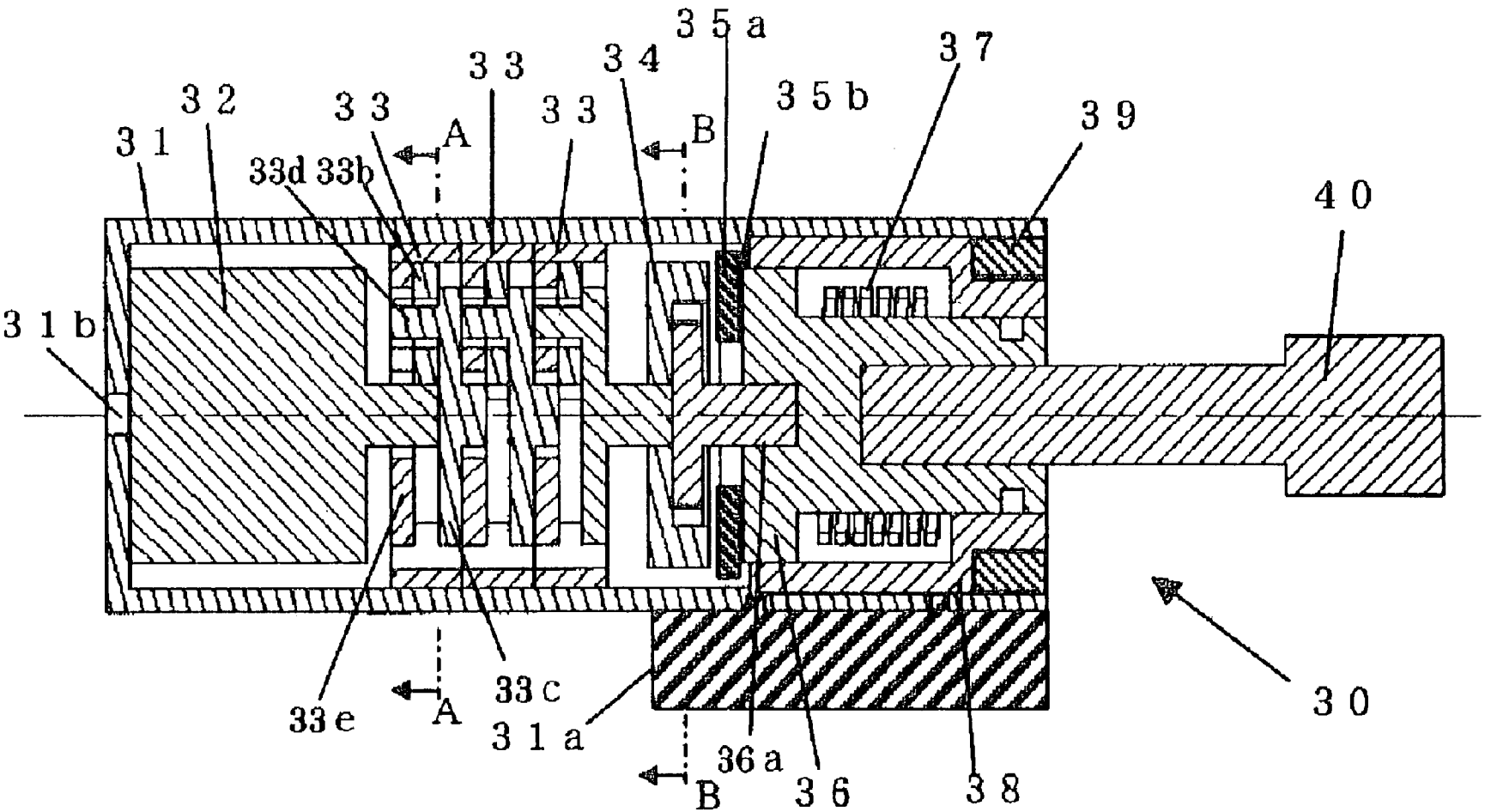
FIG. 4 is a sectional view of the automatic lifting and lowering device according to the present invention.
Figure 5:
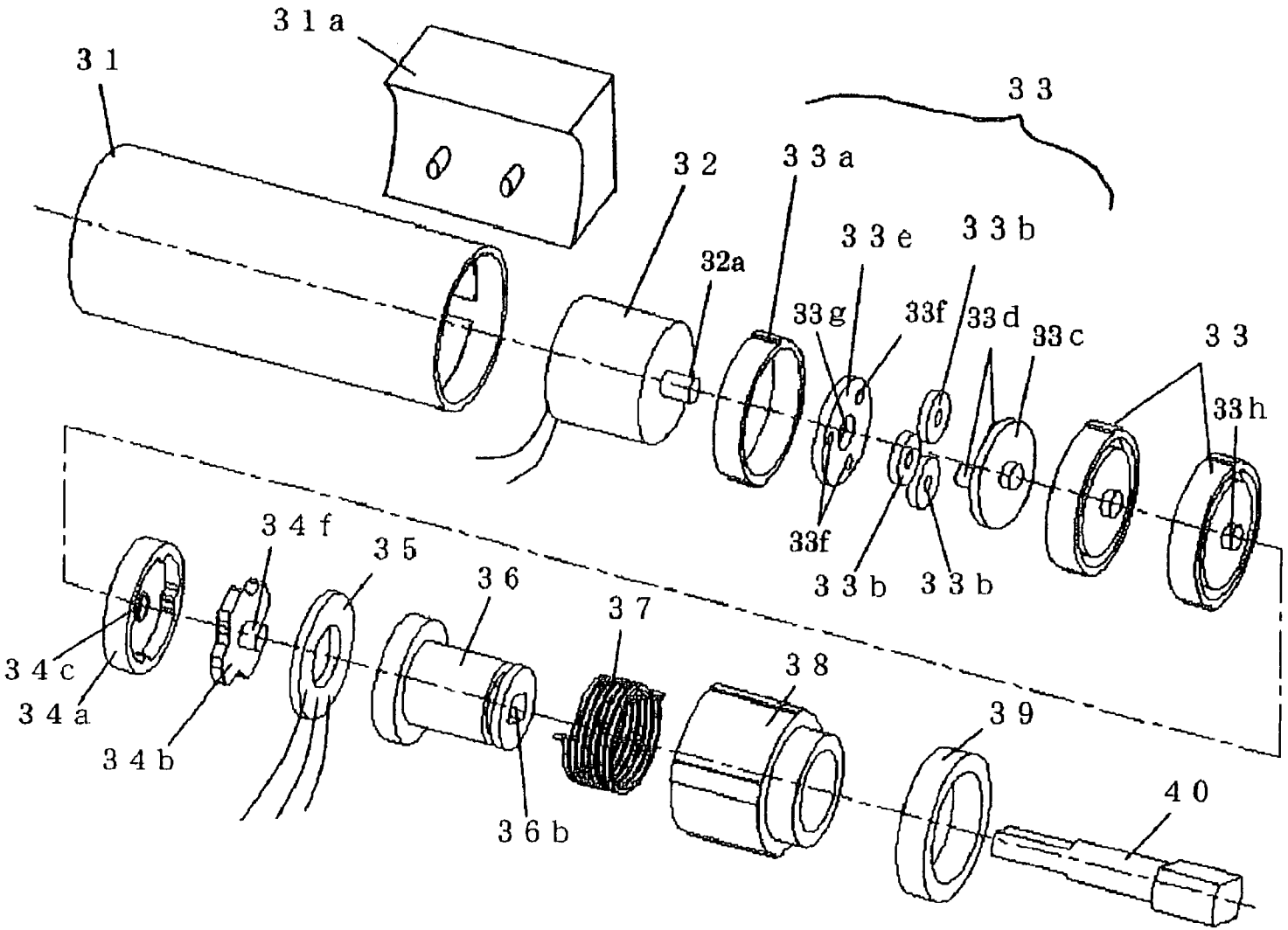
FIG. 5 is an exploded perspective view of the automatic lifting and lowering device according to the present invention.

FIG. 4 shows a sectional view of the automatic lifting and lowering device 30, and FIG. 5 shows an exploded perspective view thereof. As shown in the drawings, the automatic lifting and lowering device 30 comprises the functional parts storage tube 31 in a tubular shape, the fixing block 31*a*, a drive motor 32, planetary gear mechanisms 33 (three stages in series in this embodiment), a torque limiter mechanism 34, a potentiometer 35, a bearing 36, a torsion spring 37, a spring bearing 38, and a fixing member 39. One end of the functional parts storage tube 31 has an electric wire takeoff hole 31*b* and the other end thereof is open. The fixing block 31*a* unrotatably fixes the functional parts storage tube 31 on the toilet seat 12. The drive motor 32 is composed of a DC brush motor or the like. The planetary gear mechanisms 33 compose a speed reduction gear train. The torque limiter mechanism 34 does not transmit a load to the speed reduction gear train when the load applied to the rotating shaft 40 is equal to or greater than a set value. The potentiometer 35 detects the rotational position of the toilet seat 12. The bearing 36 has an insertion hole 36*b*, into which the rotating shaft 40 is inserted. The torsion spring 37 always biases the toilet seat 12 in a lifting direction. The spring bearing 38 is fixed unrotatably with respect to the functional parts storage tube 31. The fixing member 39 fixes the spring bearing 38 inside the functional parts storage tube 31. An internal thread, into which the fixing member 39 is screwed, is formed in the inner periphery of the open end of the functional parts storage tube 31. Serrations are formed in the inner periphery of the functional parts storage tube 31 on the deeper side of the internal thread to make an internal gear 33*a* (described later) and the spring bearing 38 unrotatable.

A sun gear 32*a* is press-fitted into an output shaft of the drive motor 32 so that the drive motor 32 can be mechanically coupled to the planetary gear mechanism 33 described later.

Figure 6:
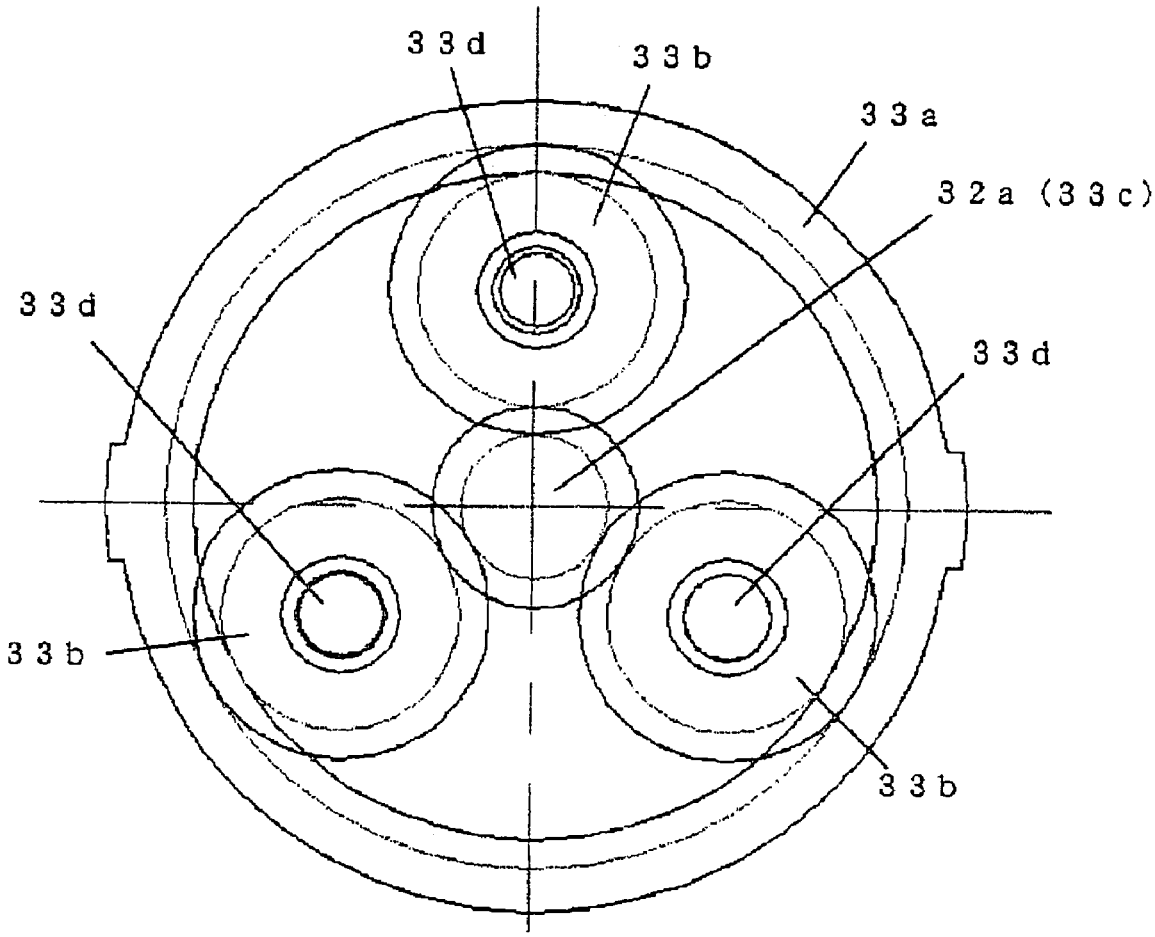
FIG. 6 is a sectional view taken along the line A-A in FIG. 4.

Next, the planetary gear mechanisms 33 as the speed reduction gear train used in the automatic lifting and lowering device 30 will be described with reference to FIG. 6.

The planetary gear mechanism 33 comprises an internal gear 33*a* provided in the inner periphery of the functional parts storage tube 31, a plurality of planetary gears 33*b* engaged with the internal gear 33*a*, and a sun gear 33*c* engaged with the planetary gears 33*b*. The foregoing planetary gears 33*b* are rotatably supported on their axes by protruding shafts 33*d*, which protrude from the rear face of the sun gear 33*c*, respectively. The protruding shafts 33*d* are circularly provided at regular intervals. For example, the three protruding shafts 33*d* are provided at intervals of 120°, and the three planetary gears 33*b* are attached thereto.

The planetary gears 33*b* are integrated into the planetary gear mechanism 33 by providing a lid 33*e*, which has fixing holes 33*f* for integrating end portions of the protruding shafts 33*d* and a sun gear insertion hole 33*g*.

Figure 7:
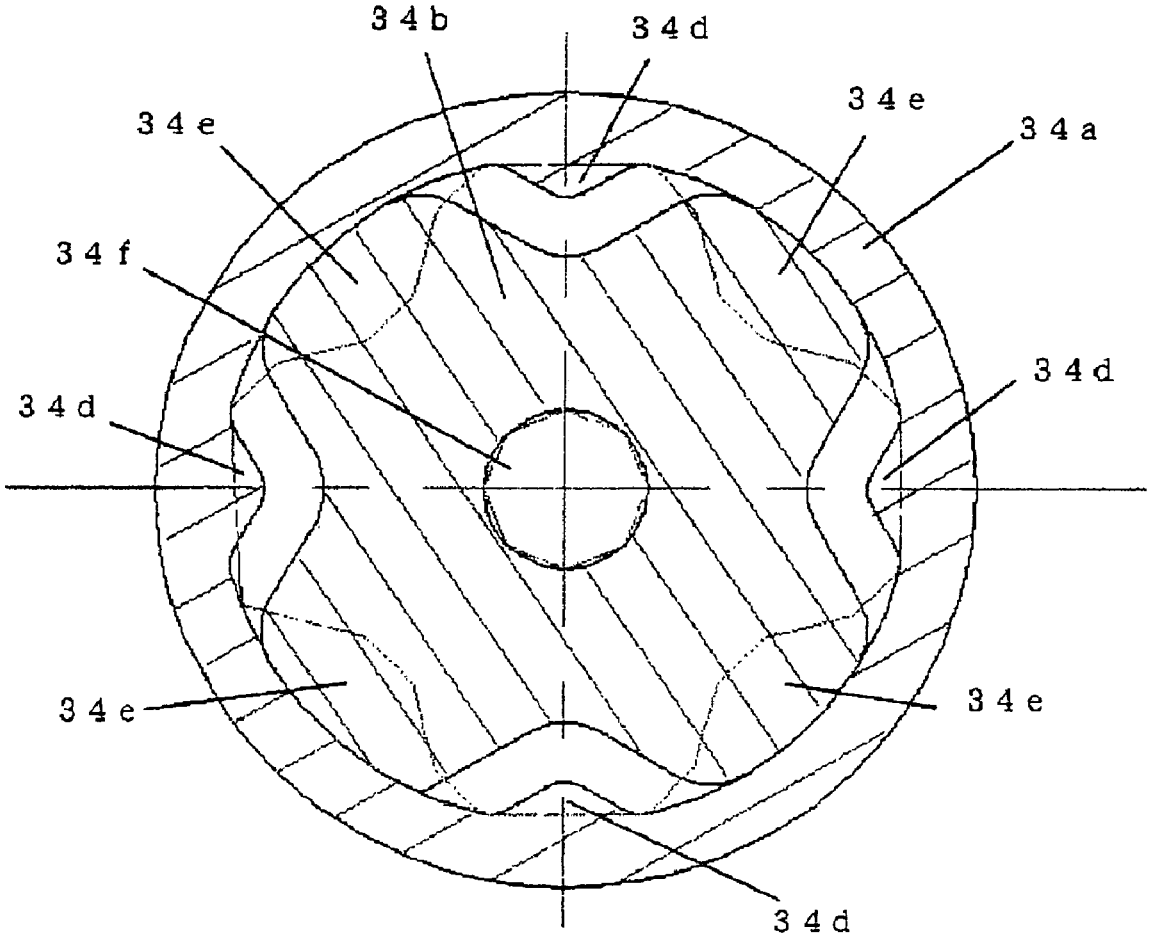
FIG. 7 is a sectional view taken along the line B-B in FIG. 4.

Then, the torque limiter mechanism 34 used in the automatic lifting and lowering device 30 will be described with reference to FIG. 7.

The torque limiter mechanism 34 comprises a torque transmission gear 34*a* unrotatably fixed on the sun gear 33*c* of the planetary gear mechanism 33 in the final stage, and a friction gear 34*b*. The torque transmission gear 34*a* is formed in the shape of a disk with an edge. A hole 34*c*, which is approximately in the same shape as a projecting shaft 33*h* on the front side of the sun gear 33*c*, is formed in the center of the torque transmission gear 34*a*. Transmission protrusions 34*d* are provided on the inner wall of the edge. The friction gear 34*b* is made of elastic material such as rubber or the like in the shape of a cross. When a load is equal to or less than a predetermined value, outer protrusions 34*e* receive torque from the transmission protrusions 34*d*. When the load exceeds the predetermined value, the outer protrusions 34*e* are deformed by the transmission protrusions 34*d* so that torque is not transmitted to the friction gear 34*b*. A power transmission projection 34*f* is provided in the center of the friction gear 34*b*.

The absolute position of the toilet seat 12 is detected by the potentiometer 35, which is installed between the torque limiter mechanism 34 and the bearing 36 (described later). The potentiometer 35 comprises a single printed wiring board 35*a* attached to the bearing 36 and a position brush 35*b* provided on an end of the spring bearing 38. A pattern portion and a print resistance portion are concentrically formed on the printed wiring board 35*a*. The central angle of the print resistance portion corresponds to the rotation angle of the toilet seat during lifting and lowering. An end portion of the position brush 35*b* is slidably in contact with and electrically connected to the pattern portion and the print resistance portion. Since the bearing 36 rotates in accordance with the rotation of the toilet seat 12, the position of the position brush 35*b* with respect to the printed wiring board 35*a* varies. The position of the position brush 35*b* is electrically detected to detect the position of the toilet seat 12.

An engaging hole 36*a* is provided in one end of the bearing 36 in order to unrotatably couple the bearing 36 to the power transmission projection 34*f* of the friction gear 34*b*. An engaging hole 36*b* is provided in the other end thereof in order to unrotatably couple the bearing 36 to the rotating shaft 40 of the toilet seat 12.

One end of the torsion spring 37 is fixed on the bearing 36, and the other end thereof is fixed on the spring bearing 38. The torsion spring 37 biases the toilet seat 12 on a lifting side by use of torsion power. (Actually, the toilet seat 12 is lowered against the bias of the torsion spring 37 by the weight of itself.)

A fixing portion for fixing the torsion spring 37 is provided in the inner periphery of the spring bearing 38, and serrations are provided in the outer periphery thereof.

An external thread is formed in the outer periphery of the anti-slip fixing member 39. The external thread is screwed into the internal thread formed in the inner wall of the functional parts storage tube 31 in order to integrally contain each part described above into the functional parts storage tube 31.

According to the foregoing structure, torque of the drive motor 32 is transmitted to the toilet seat 12 through the sun gear 32*a* attached to the output shaft of the drive motor 32→the first planetary gear mechanism (the planetary gears 33*b* (rotation→revolution)→the sun gear 33*c*)→the second planetary gear mechanism (the planetary gears 33*b* (rotation→revolution)→the sun gear 33*c*)→the final planetary gear mechanism (the planetary gears 33*b* (rotation→revolution)→the sun gear 33*c*)→the torque limiter mechanism 34 (the torque transmission gear 34*a*→the friction gear 34*b*)→the spring bearing 36→the rotating shaft 40 so that the toilet seat 12 is lifted or lowered. Since the potentiometer 35 detects the lifting angle of the toilet seat 12, and the drive motor 32 is subjected to feedback control, it is possible to realize a gentle lifting and lowering operation.

In the automatic lifting and lowering device according to this embodiment, torque of the drive motor 32 is transmitted to the rotating shaft 40 of the toilet seat and cover through the planetary gear mechanisms 33. Thus, it is possible to concentrically dispose the drive motor 32, the planetary gear mechanisms 33, and the rotating shaft 40. The outside shape of the whole device is formed in a circular shape concentric with the rotating shaft 40, with respect to a plane of projection orthogonal to the center of the rotating shaft 40. Therefore, the automatic lifting and lowering device 30 is easily compatible with a loose lowering unit, which is often used for lifting and lowering a toilet seat and cover of a toilet with a function of washing a body with hot water, and the like. Accordingly, the design of such kind of toilet seat containing the automatic lifting and lowering device becomes extremely easy.

It is also possible to miniaturize the speed reduction mechanism of the automatic lifting and lowering device because the output shaft of the drive motor 32, the rotating shaft of the sun gear 33*c* of the planetary gear mechanism 33, and the centers of the sun gears 33*c* of the multi-stage planetary gear mechanisms are disposed in a concentric manner.

Furthermore, since the rotating shafts 40 of the toilet seat 12 and the toilet cover 13 are disposed concentrically with the output shaft of the drive motor 32, the attachment area of the device itself becomes small. Thus, other functional parts can be disposed below the rotating shafts 40 of the toilet seat 12 or the toilet cover 13 so that it is possible to install the automatic lifting and lowering device without increasing the size of the toilet seat provided with a function of washing a body with hot water. Since the planetary gear mechanisms 33 are disposed in plural stages in series, the relatively small drive motor 32 and planetary gear mechanisms 33 are available.

Furthermore, the torque limiter mechanism 34 is provided between the output shaft 33*h* of the planetary gear mechanism 33 in the final stage and the rotating shaft 40. Therefore, even if an excessive load is applied to the rotating shaft in such cases where the toilet seat 12 or the toilet cover 13 is manually held during the automatic lifting and lowering operations, the excessive load is not applied to the planetary gear mechanism 33.

The potentiometer 35 for detecting an lifting and lowering state of the toilet seat 12 and the toilet cover 13 is provided between the output shaft 33*h* of the planetary gear mechanism 33 in the final stage and the rotating shaft 40. Therefore, even if a cog of the gear is chipped, for example, the lifting and lowering positions of the cover 12 and the seat 13 do not deviate so that it is possible to realize a stable operation.

The outside diameter of the planetary gear mechanisms 33 is approximately the same as that of the drive motor 32 so that it is possible to optimize the balance between torque generated by the drive motor 32 and the speed reducing ratio of the planetary gear mechanisms 33. Therefore, it is possible to design the planetary gear mechanisms 33 and drive motor 32 with a minimum of size.

Furthermore, since the planetary gear mechanism 33 is composed of the plurality of planetary gears 33*b*, a load applied to the planetary gear mechanism 33 is dispersed to each planetary gear 33*b*. Thus, each planetary gear can be designed so as to have small disruptive strength. Providing the three protruding shafts 33*d* of the sun gear 33*c* which receives the revolution of the planetary gears 33*b* at regular intervals makes it possible to stably rotate the sun gear 33*c*.

Figure 8:
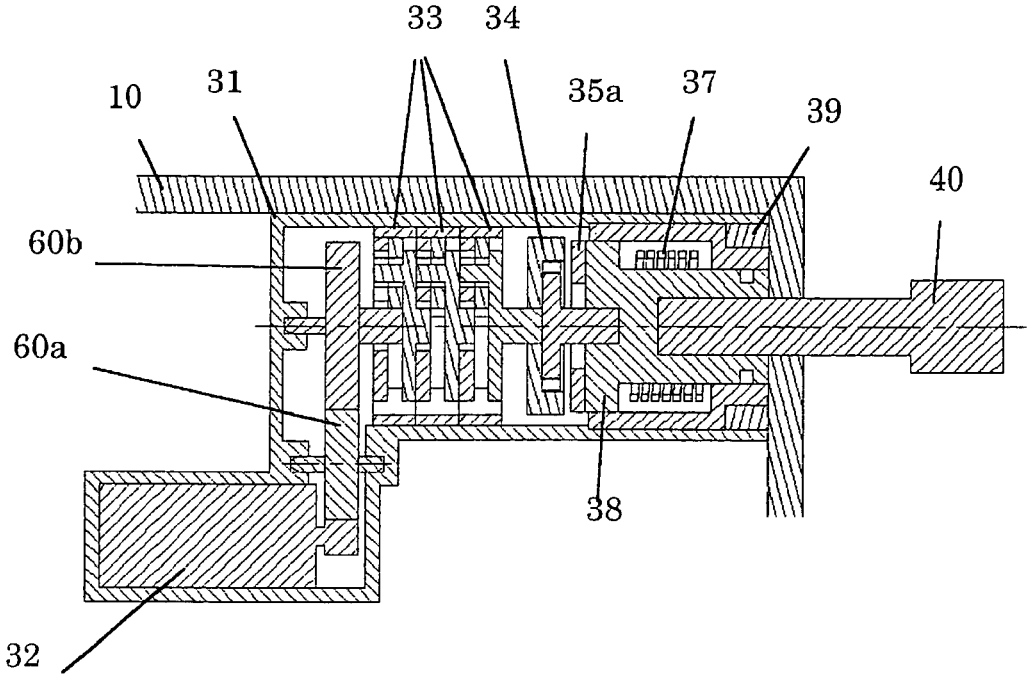
FIG. 8 is a sectional view of an automatic lifting and lowering device according to a second embodiment of the present invention.

FIG. 8 shows a second embodiment of the automatic lifting and lowering device according to the present invention. The same reference numerals as the first embodiment refer to parts identical to those of the first embodiment.

In this embodiment, the drive motor 32 and the planetary gear mechanisms 33 as the speed reduction gear train are mechanically coupled with the use of spur gears 60*a* and 60*b*. Using the spur gears 60*a* and 60*b* for transmitting the drive force of the drive motor 32 makes it possible to dispose the drive motor 32, the speed reduction gear train, and the rotating shaft 40 in parallel with each other. Thus, it is possible to dispose other functional parts on the sides of the automatic lifting and lowering device 30 of the toilet seat 12 or the toilet cover 13 so that the variations of the housing design further expand. To transmit the drive force of the drive motor 32 in parallel, a helical gear, a double helical gear, or the like may be used instead of the spur gear.

Figure 9:
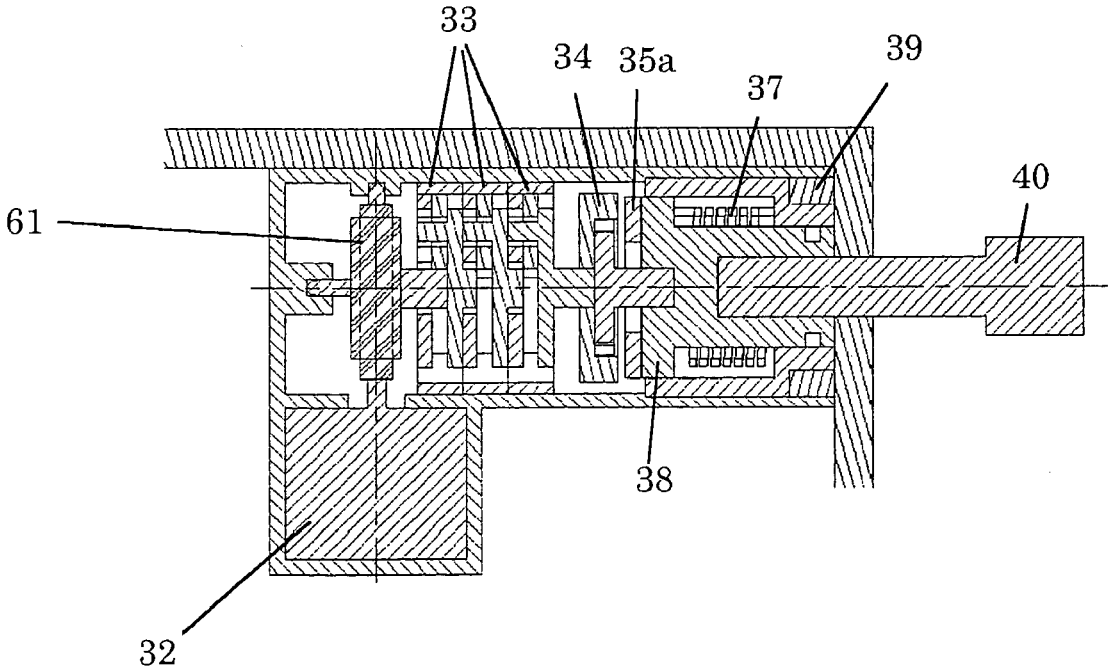
FIG. 9 is a sectional view of an automatic lifting and lowering device according to a third embodiment of the present invention.

FIG. 9 shows a third embodiment of the automatic lifting and lowering device according to the present invention. The same reference numerals as the first embodiment refer to parts identical to those of the first embodiment.

In this embodiment, the drive motor 32 and the planetary gear mechanisms 33 as the speed reduction gear train are mechanically coupled with the use of a worm gear 61. The protruding shaft 33*d* of the planetary gear mechanism 33 in the first stage, which engages with the worm gear 61, does not take the shape of a spur gear but a helical gear. Using the worm gear 61 for transmitting the drive force of the drive motor 32 makes it possible to dispose the drive motor 32, the speed reduction gear train, and the rotating shaft 40 in an orthogonal or staggered manner. Thus, it is possible to dispose other functional parts beside or below the automatic lifting and lowering device 30 of the toilet seat 12 or the toilet cover 13 so that the variations of the housing design further expand.

To transmit the drive force of the drive motor 32 in an orthogonal or staggered manner, a straight bevel gear, a spiral bevel gear, a face gear, a hypoid gear, a crossed helical gear, or the like may be used instead.

Figure 10:
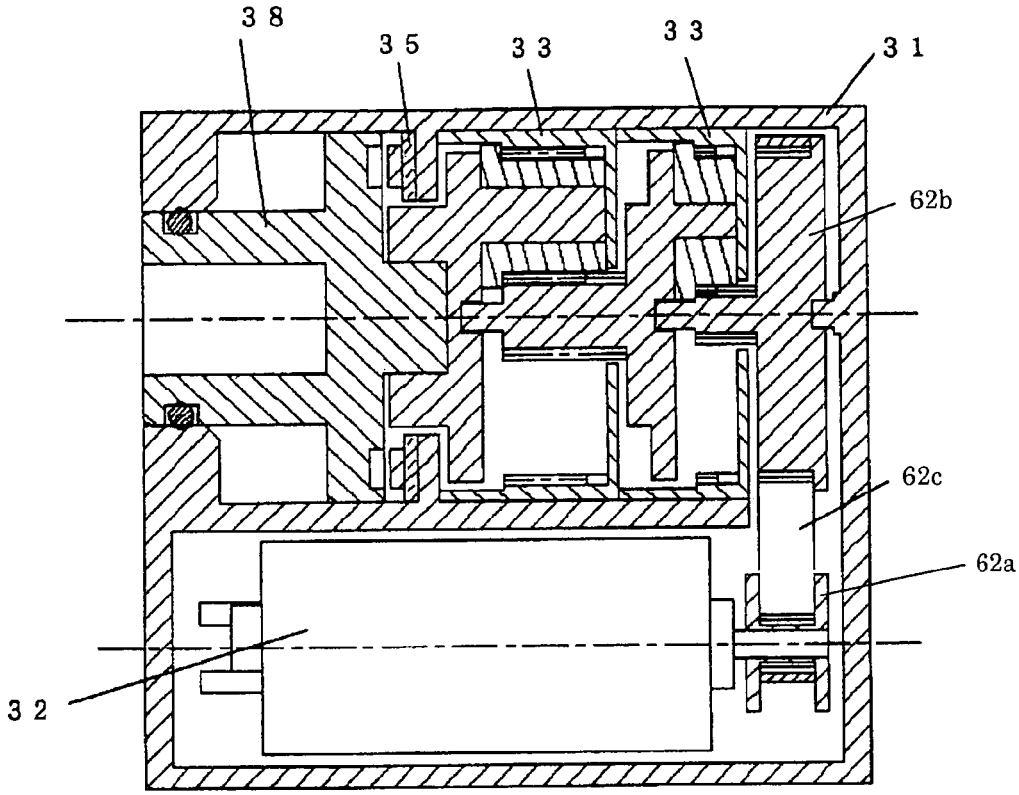
FIG. 10 is a sectional view of an automatic lifting and lowering device according to a fourth embodiment of the present invention.

FIG. 10 shows a fourth embodiment of the automatic lifting and lowering device 30 according to the present invention. The same reference numerals as the first embodiment refer to parts identical to those of the first embodiment.

In this embodiment, the drive motor 32 and the planetary gear mechanisms 33 as the speed reduction gear train are mechanically coupled with the use of wrapping transmission means (which comprises a small pulley 62*a*, a large pulley 62*b*, and a timing belt 62*c*). By using the wrapping transmission means for transmitting the drive force of the drive motor 32, as described above, the distance between the drive motor 32 and the planetary gear mechanisms 33 as the speed reduction gear train is set appropriately. Thus, it is possible to increase degree of freedom in the layout design for the drive motor, the speed reduction gear train, and the rotating shaft 40 of the automatic lifting and lowering device for the toilet seat or the toilet cover.

Since noise caused by the bump of the small pulley 62*a* and the gear does not occur, it is possible to decrease operation noise. A flat belt, a V-belt, a cogged belt, or the like may be used as the timing belt 62*c*.

Figure 11:
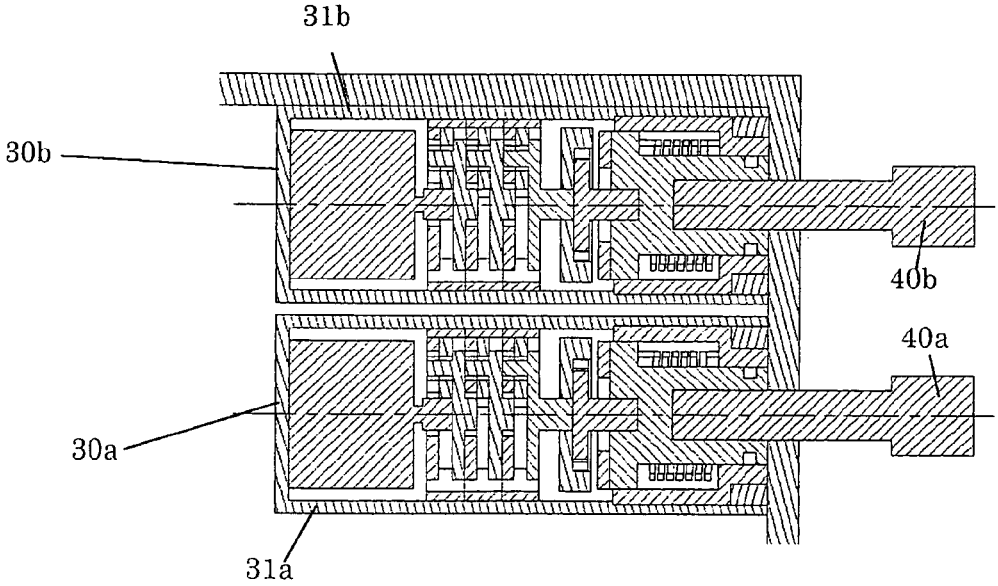
FIG. 11 is a sectional view showing another example of the automatic lifting and lowering device according to the first embodiment of the present invention.

FIG. 11 shows an example in which the automatic lifting and lowering devices 30 according to the first embodiment are disposed in parallel with each other as an automatic lifting and lowering device 30*a* for the toilet seat 12 and an automatic lifting and lowering device 30*b* for the toilet cover 13. The automatic toilet seat lifting and lowering device 30*a* and the automatic toilet cover lifting and lowering device 30*b* are intensively installable on one side in accordance with relation with other functional parts in the toilet seat apparatus 10 as described above so that it is possible to further make the design of housing easier.

Figure 12:
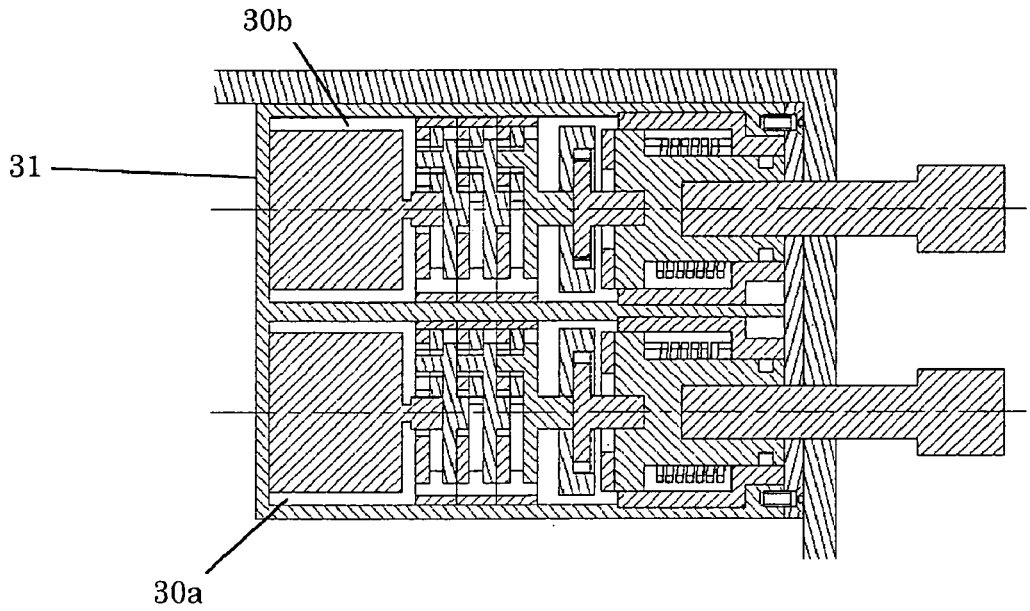
FIG. 12 is a sectional view showing further another example of the automatic lifting and lowering device according to the first embodiment of the present invention.

When the automatic lifting and lowering devices 30*a* and 30*b* are intensively installed on one side like this, the automatic lifting and lowering device 30*a* for the toilet seat 12 and the automatic lifting and lowering device 30*b* for the toilet cover 13, as shown in FIG. 12, constitute the integral functional parts storage tube 31. Therefore, it is possible to reduce the size and cost of the automatic lifting and lowering device.

Figure 13:
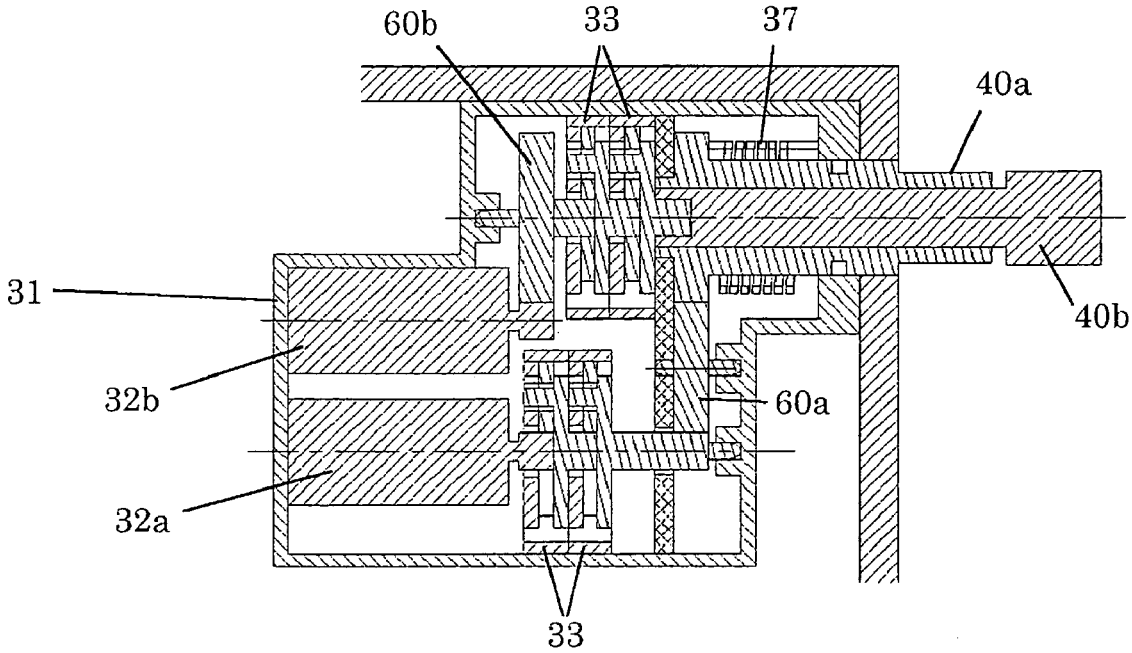
FIG. 13 is a sectional view of an automatic lifting and lowering device according to a fifth embodiment of the present invention.

FIG. 13 shows a fifth embodiment of an automatic lifting and lowering device 30 according to the present invention. The same reference numerals as the first embodiment refer to parts identical to those of the first embodiment.

According to this embodiment, an output shaft 40*a* and a protruding shaft 33*d* of a planetary gear mechanism 33 are coupled by a spur gear 60*a* in an automatic lifting and lowering device 30*a* for a toilet seat 12. An automatic lifting and lowering device 30*b* for a toilet cover 13 is identical to the automatic lifting and lowering device 30 according to the first embodiment (a spur gear 60*a* is omitted). These automatic lifting and lowering devices 30*a* and 30*b* are integrally contained, and the output shaft 40*a* of the automatic lifting and lowering device 30*a* for the toilet seat 12 is disposed concentrically with an output shaft 40*b* of the automatic lifting and lowering device 30*b* for the toilet cover 13 so that the rotating shafts 40*a* and 40*b* of the toilet seat 12 and the toilet cover 13 are integrated. Therefore, it becomes extremely easy to compactly design the vicinity of the rotating shaft 40.

Figure 14:
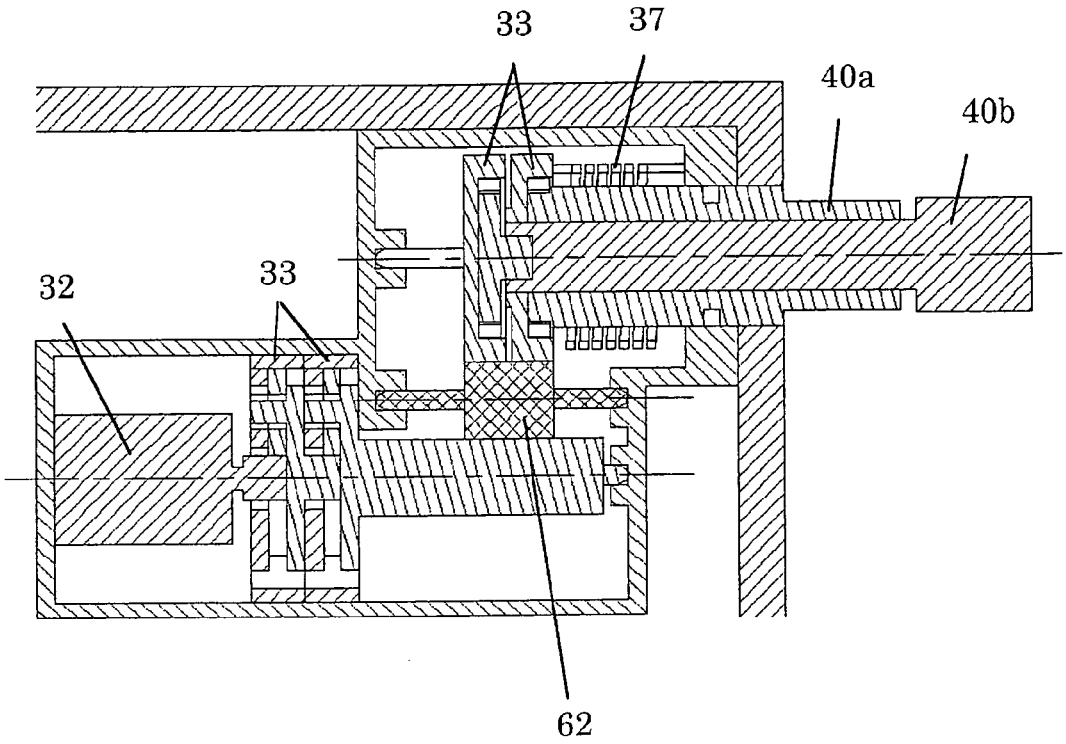
FIG. 14 is a sectional view of an automatic lifting and lowering device according to a sixth embodiment of the present invention, in which a toilet seat and a toilet cover are simultaneously driven.
Figure 15:
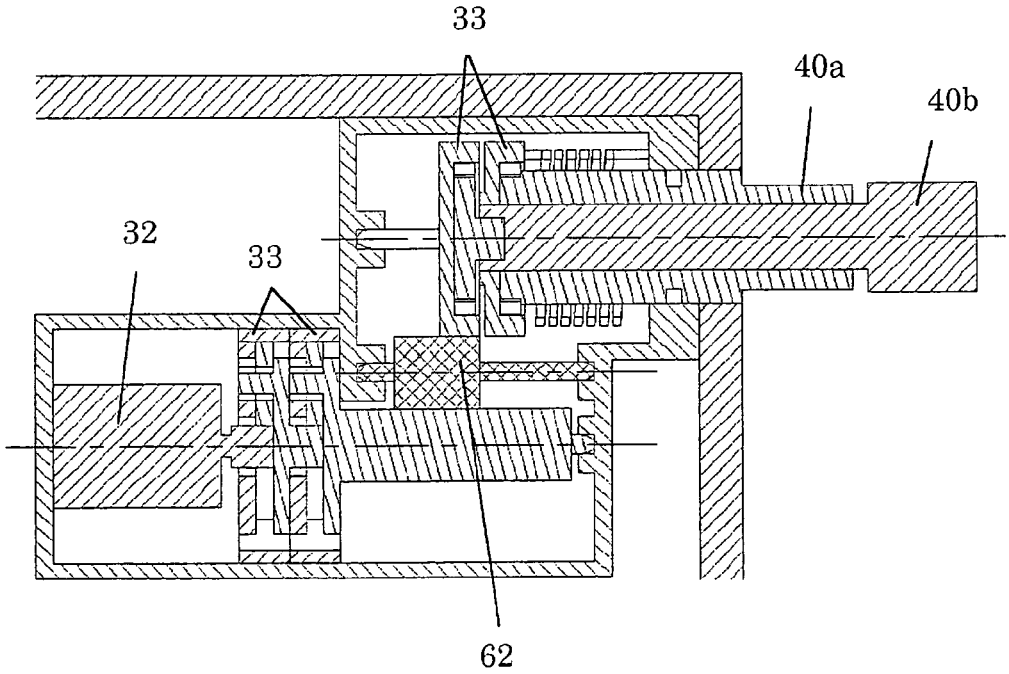
FIG. 15 is a sectional view of the automatic lifting and lowering device according to the sixth embodiment of the present invention, in which only the toilet cover is driven.
Figure 16:
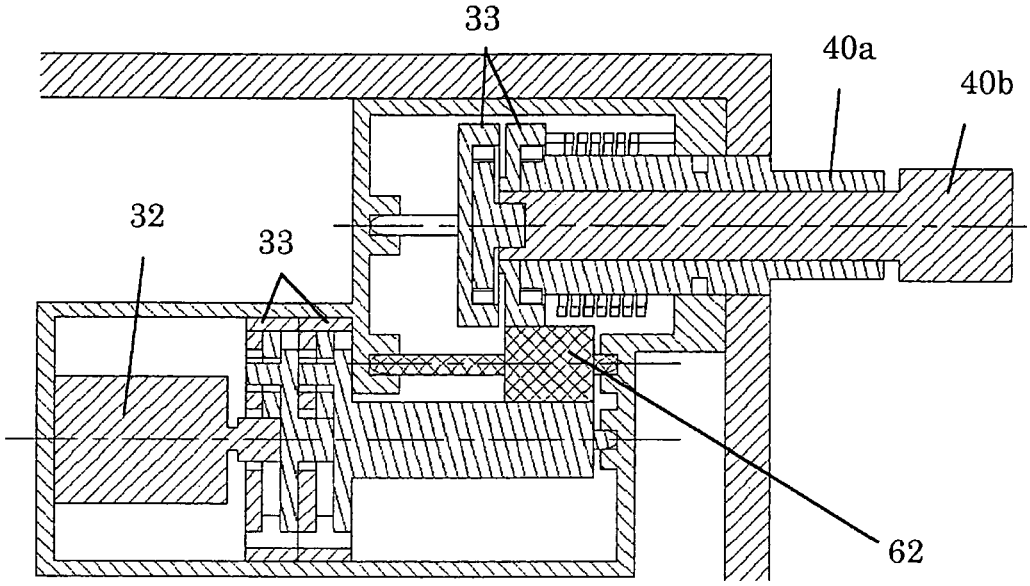
FIG. 16 is a sectional view of the automatic lifting and lowering device according to the sixth embodiment of the present invention, in which only the toilet seat is driven.

FIGS. 14, 15, and 16 show a sixth embodiment of an automatic lifting and lowering device 30 according to the present invention. The same reference numerals as the first embodiment refer to parts identical to those of the first embodiment.

In this embodiment, an automatic lifting and lowering device 30*a* for a toilet seat 12 is integrated with an automatic lifting and lowering device 30*b* for a toilet cover 13. An output shaft 40*a* of the automatic lifting and lowering device 30*a* for the toilet seat 12 is disposed concentrically with an output shaft 40*b* of the automatic lifting and lowering device 30*b* for the toilet cover 13. A drive motor 32 is shared between the automatic lifting and lowering device 30*a* for the toilet seat 12 and the automatic lifting and lowering device 30*b* for the toilet cover 13. A switching gear 62 is used for switching the drive of the automatic lifting and lowering device 30*a* for the toilet seat 12 and the drive of the automatic lifting and lowering device 30*b* for the toilet cover 13. When the switching gear 62 is in a position shown in FIG. 14, both of the toilet seat 12 and the toilet cover 13 are coupled to the drive motor 32 through the gear 62 so that the toilet seat 12 and the toilet cover 13 are simultaneously driven. When the switching gear 62 is in a position shown in FIG. 15, only the toilet cover 13 is coupled to the drive motor 32 so that only the toilet cover 13 is driven. When the switching gear 62 is in a position shown in FIG. 16, only the toilet seat 12 is coupled to the drive motor 32 so that only the toilet seat 12 is driven. The movement of the switching gear 62 is controlled by a not-illustrated electromagnetic solenoid or the like. Therefore, only the single drive motor 32 drives the automatic lifting and lowering device 30*a* for the toilet seat 12 and the automatic lifting and lowering device 30*b* for the toilet cover 13 so that it is possible to reduce the size and cost of the automatic lifting and lowering device.

Figure 17:
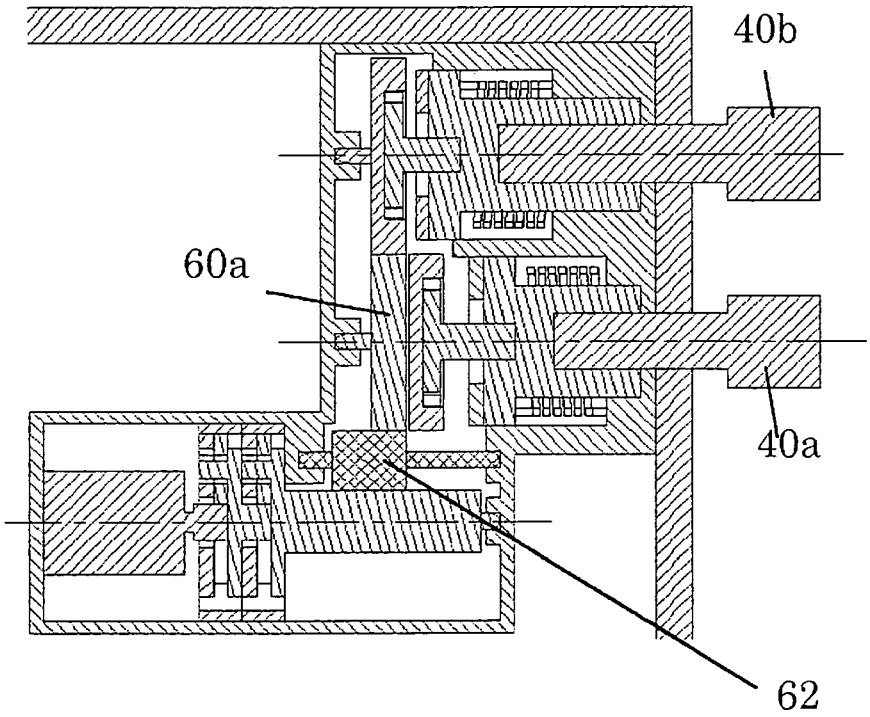
FIG. 17 is a sectional view showing another example of the automatic lifting and lowering device according to the sixth embodiment of the present invention, in which the toilet seat and the toilet cover are simultaneously driven.
Figure 18:
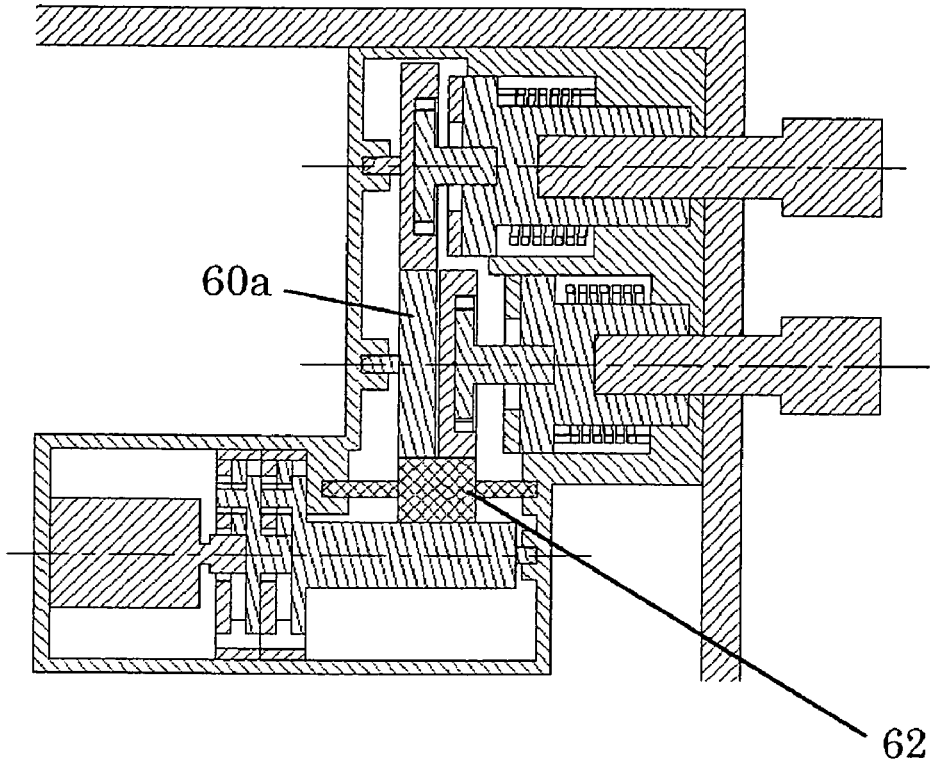
FIG. 18 is a sectional view showing the example of the automatic lifting and lowering device according to the sixth embodiment of the present invention, in which only the toilet cover is driven.
Figure 19:
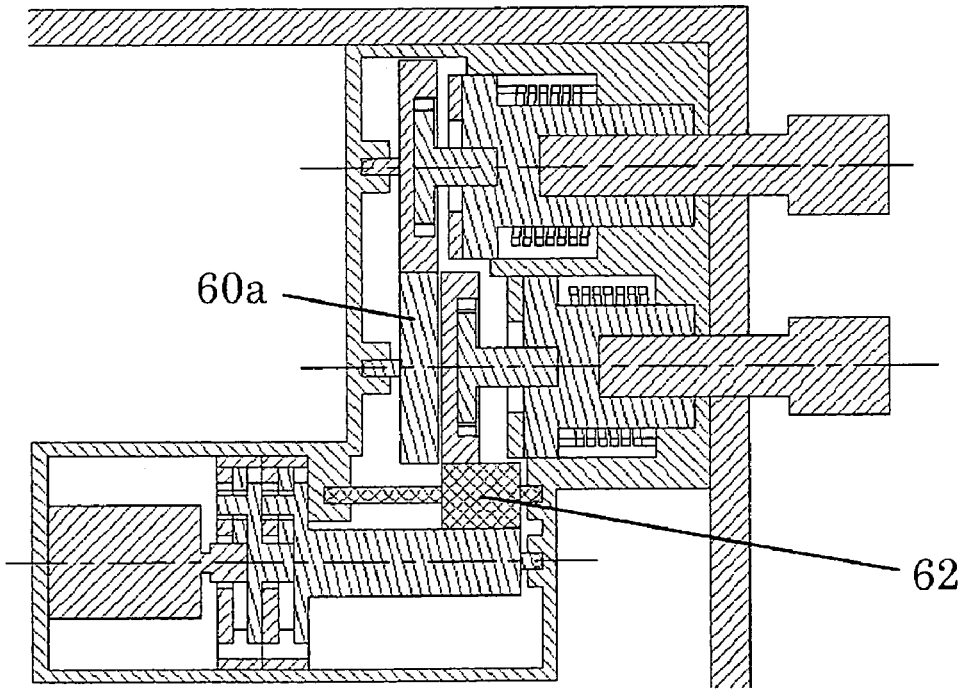
FIG. 19 is a sectional view showing the example of the automatic lifting and lowering device according to the sixth embodiment of the present invention, in which only the toilet seat is driven.

FIGS. 17, 18, and 19 show a modified example of the automatic lifting and lowering device 30 according to the sixth embodiment of the present invention. The same reference numerals as the sixth embodiment refer to parts identical to those of the sixth embodiment. In this embodiment, an output shaft 40*a* of an automatic lifting and lowering device 30*a* for a toilet seat 12 and an output shaft 40*b* of an automatic lifting and lowering device 30*b* for a toilet cover 13 are disposed in parallel with each other. Although the number of parts increases as compared with the sixth embodiment because a spur gear 60*a* becomes necessary, this structure is effective when the toilet seat 12 and the toilet cover 13 cannot be disposed concentrically due to restriction in a layout.

Figure 20:
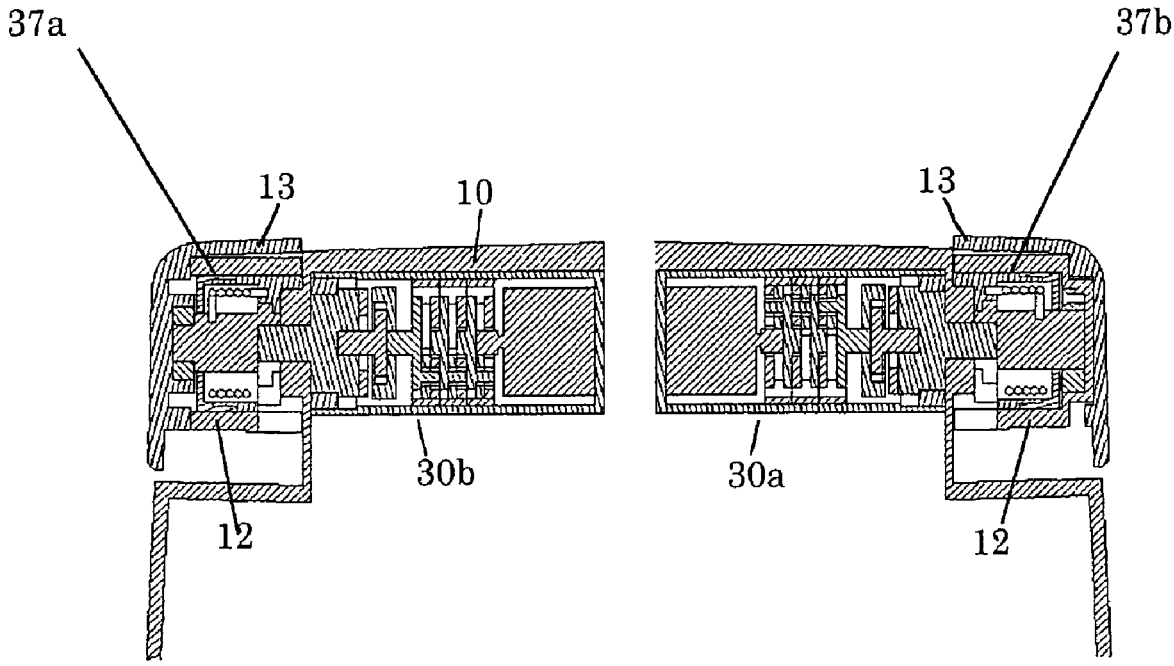
FIG. 20 is a sectional view showing further another example of the automatic lifting and lowering device according to the first embodiment of the present invention.

FIG. 20 shows a sectional view in which the automatic lifting and lowering devices 30 according to the first embodiment (except for the torsion spring 37) are installed in the toilet seat apparatus 10. In this embodiment, since the automatic lifting and lowering devices 30 are contained in a housing of the toilet seat apparatus 10, an electric wire does not come out, and hence the toilet seat apparatus 10 has a neat appearance. Since the torsion springs 37*a* and 37*b* for biasing the toilet seat 12 and the toilet cover 13 on the lifting side are inserted into the rotating block insertion portions at the base end portions of the toilet seat 12 or the toilet cover 13, it is possible to further miniaturize the automatic lifting and lowering device 30, and hence the design of housing becomes further easier. (A point that the torsion spring 37 is separately contained is described in the first embodiment in detail, and hence description of it is omitted here.)

Then, with reference to FIGS. 21 to 32, an automatic lifting and lowering device for a toilet seat or a toilet cover according to a seventh embodiment of the present invention will be described. The same reference numerals as those in FIGS. 1 to 20 are used in FIGS. 21 to 32, but they do not relate to each other. All reference numerals hereinafter described designate reference numerals shown in FIGS. 21 to 32.

Figure 21:
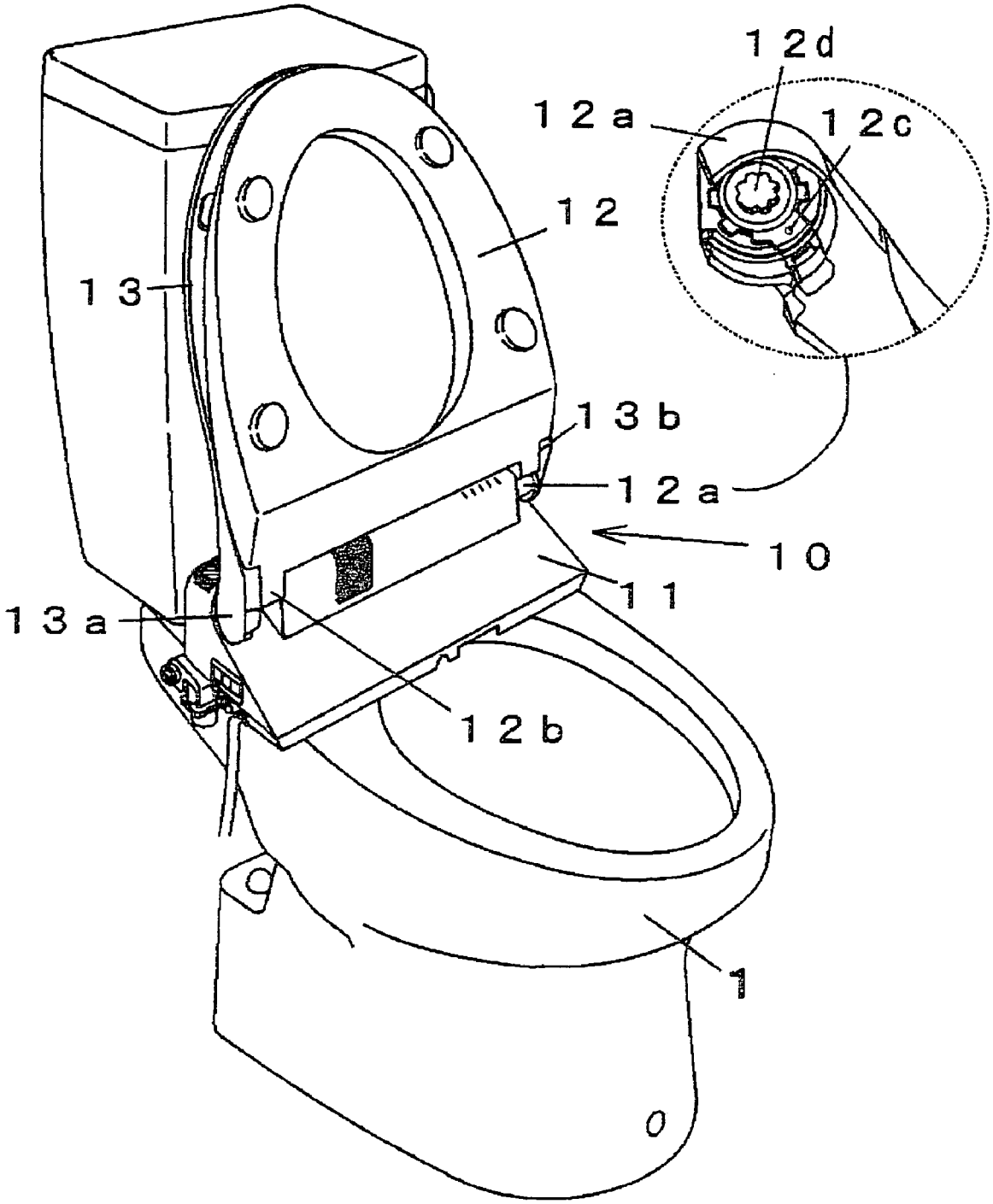
FIG. 21 is a perspective view of a toilet seat apparatus, in which an automatic toilet seat lifting and lowering device or an automatic toilet cover lifting and lowering device according to the seventh embodiment of the present invention is installed.
Figure 22:
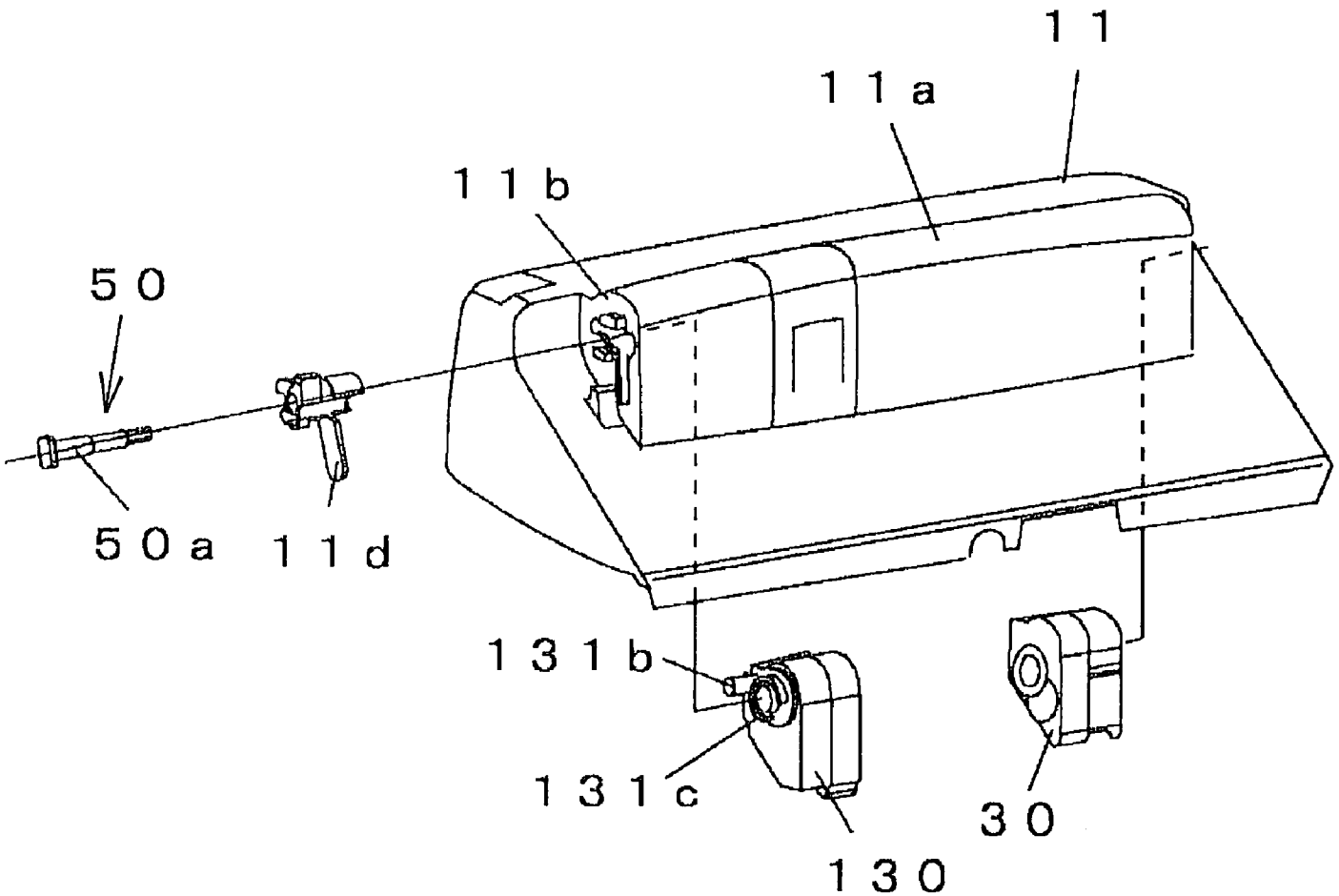
FIG. 22 is an exploded perspective view which explains the attachment position of the automatic toilet seat lifting and lowering device or the automatic toilet cover lifting and lowering device according to the seventh embodiment of the present invention.
Figure 23:
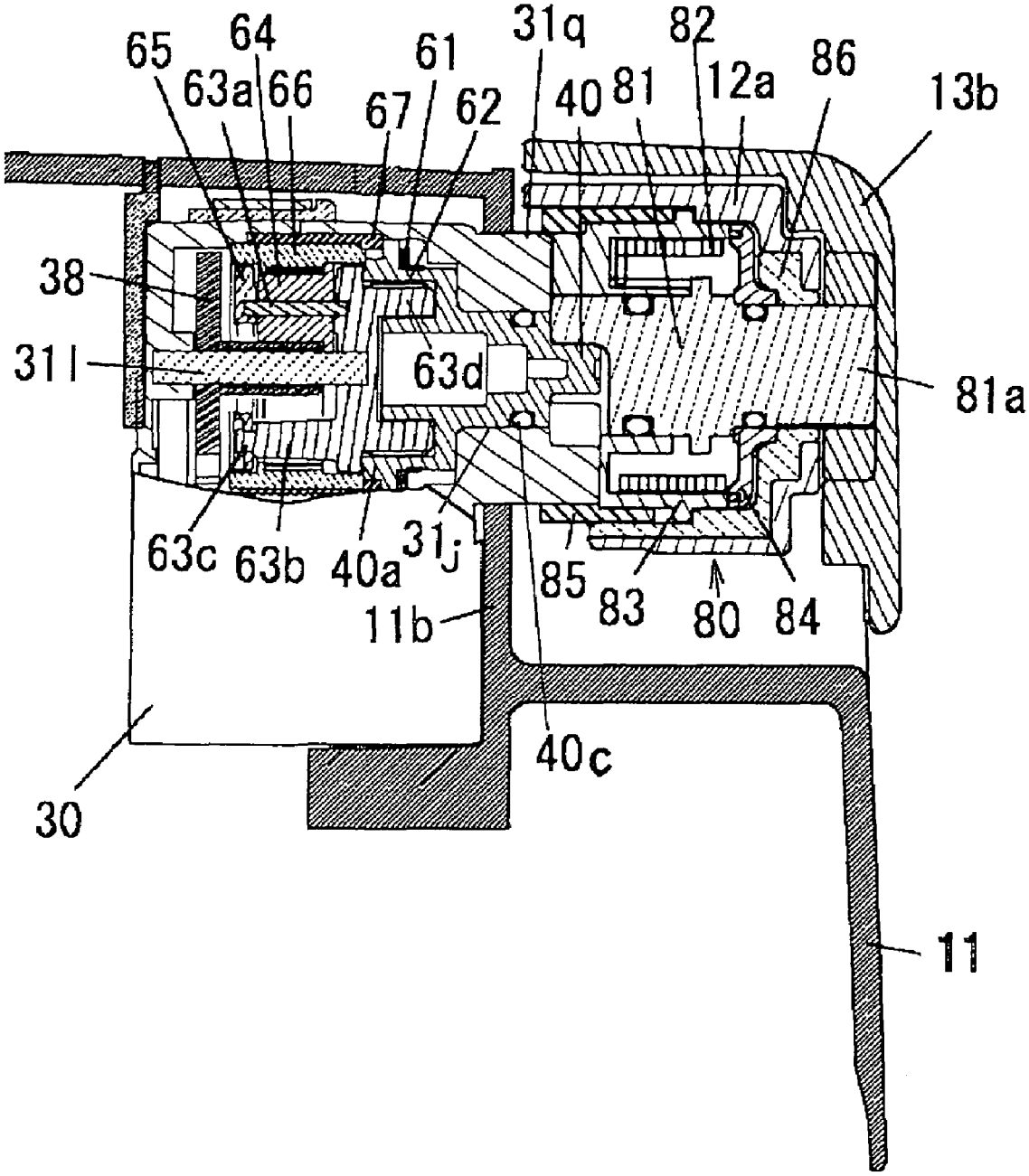
FIG. 23 is a sectional view of a toilet seat apparatus, in which the automatic toilet seat lifting and lowering device is installed.
Figure 24:
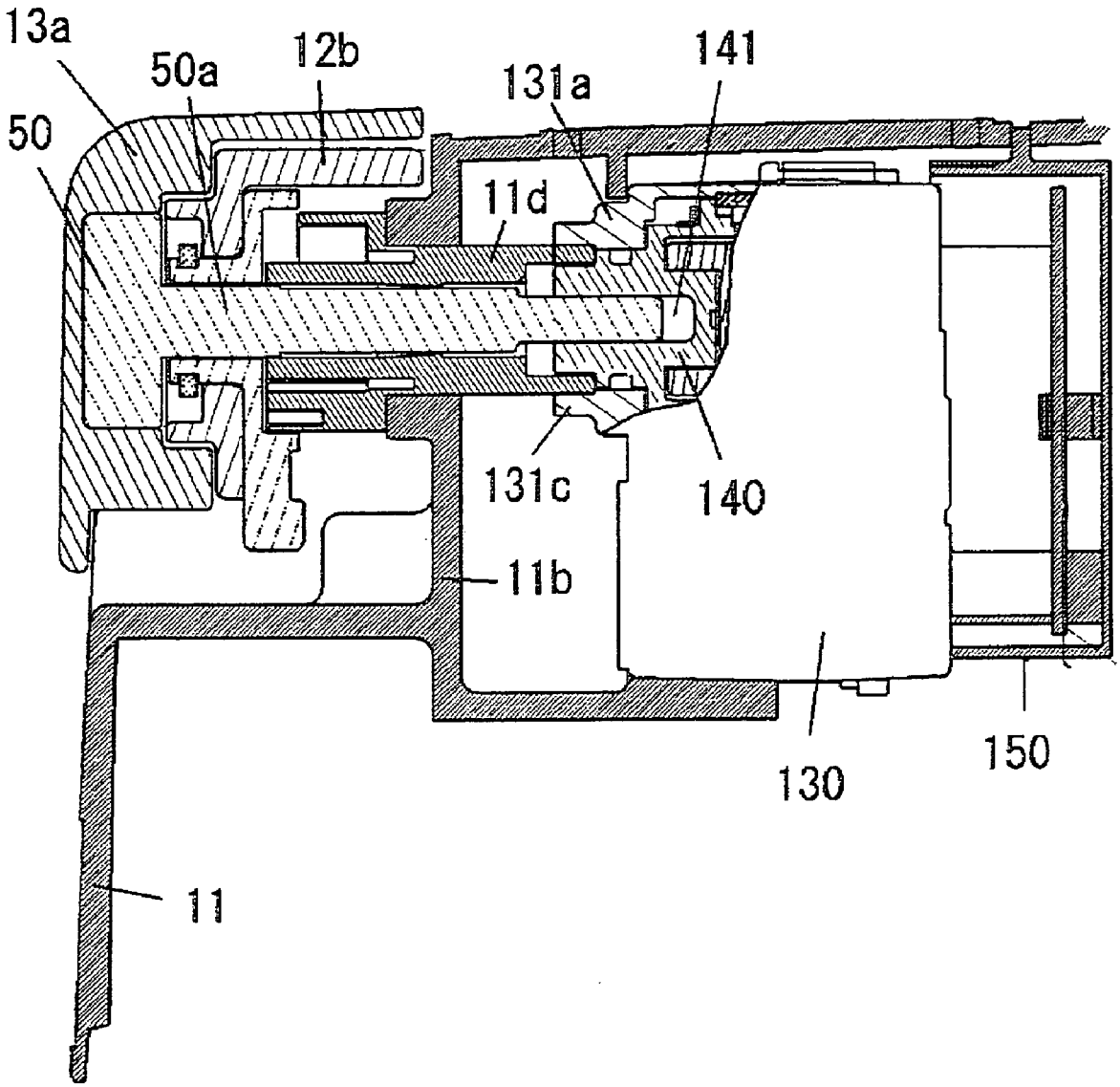
FIG. 24 is a sectional view of a toilet seat apparatus, in which the automatic toilet cover lifting and lowering device is installed.

FIG. 21 is a perspective view of a toilet seat apparatus 10, in which an automatic lifting and lowering device for a toilet seat or a toilet cover according to the seventh embodiment of the present invention is installed. FIG. 22 is an exploded perspective view which explains an attachment position of the automatic lifting and lowering device for the toilet seat or the toilet cover. FIG. 23 is a sectional view of the toilet seat apparatus 10 in which an automatic toilet seat lifting and lowering device 30 is installed, and FIG. 24 is a sectional view of the toilet seat apparatus 10 in which an automatic toilet cover lifting and lowering device 130 is installed.

In FIG. 21, a casing 11 of a toilet seat apparatus 10 is fixed by making use of the top face of a rim on the side of the back of a toilet body 1. A protruding container portion 11*a* is formed in the middle of a front side of the casing 11. The automatic toilet seat lifting and lowering device 30 and the automatic toilet cover lifting and lowering device 130 are attached to sidewalls 11*a* of the container portion 11*a*. The toilet seat 12 and the toilet cover 13 are attached to the automatic lifting and lowering devices 30 and 130, respectively. The toilet seat apparatus 10 is a hot toilet seat apparatus, in which a heater for heating the seat is provided inside the toilet seat 12.

A coupling portion 12*a* and a rotating portion 12*b* are provided in base end portions of the toilet seat 12. A coupling portion 13*a* and a rotating portion 13*b* are provided in base end portions of the toilet cover 13. As shown in FIG. 23, the coupling portion 12*a* is unrotatably coupled to a rotating shaft 40 as an output shaft of the automatic toilet seat lifting and lowering device 30 through an assist unit 80 described later. As shown in FIG. 24, the coupling portion 13*a* is unrotatably coupled to a rotating shaft 50, which is coupled to an output shaft 140 of the automatic toilet cover lifting and lowering device 130. The rotating portions 12*b* and 13*b* are rotatably coupled to support shafts 50*a* (formed in the middle of the rotating shaft 50) and 81*a* (an end portion 81*a* of a coupling shaft 81 coupled to the rotating shaft 40), which support the toilet seat 12 and the toilet cover 13, respectively, in a manner capable of lifting and lowering, respectively. In the drawings, the reference numeral 150 designates a driving circuit for driving the automatic lifting and lowering devices 30 and 130, and a potting case for protecting the driving circuit.

Figure 25:
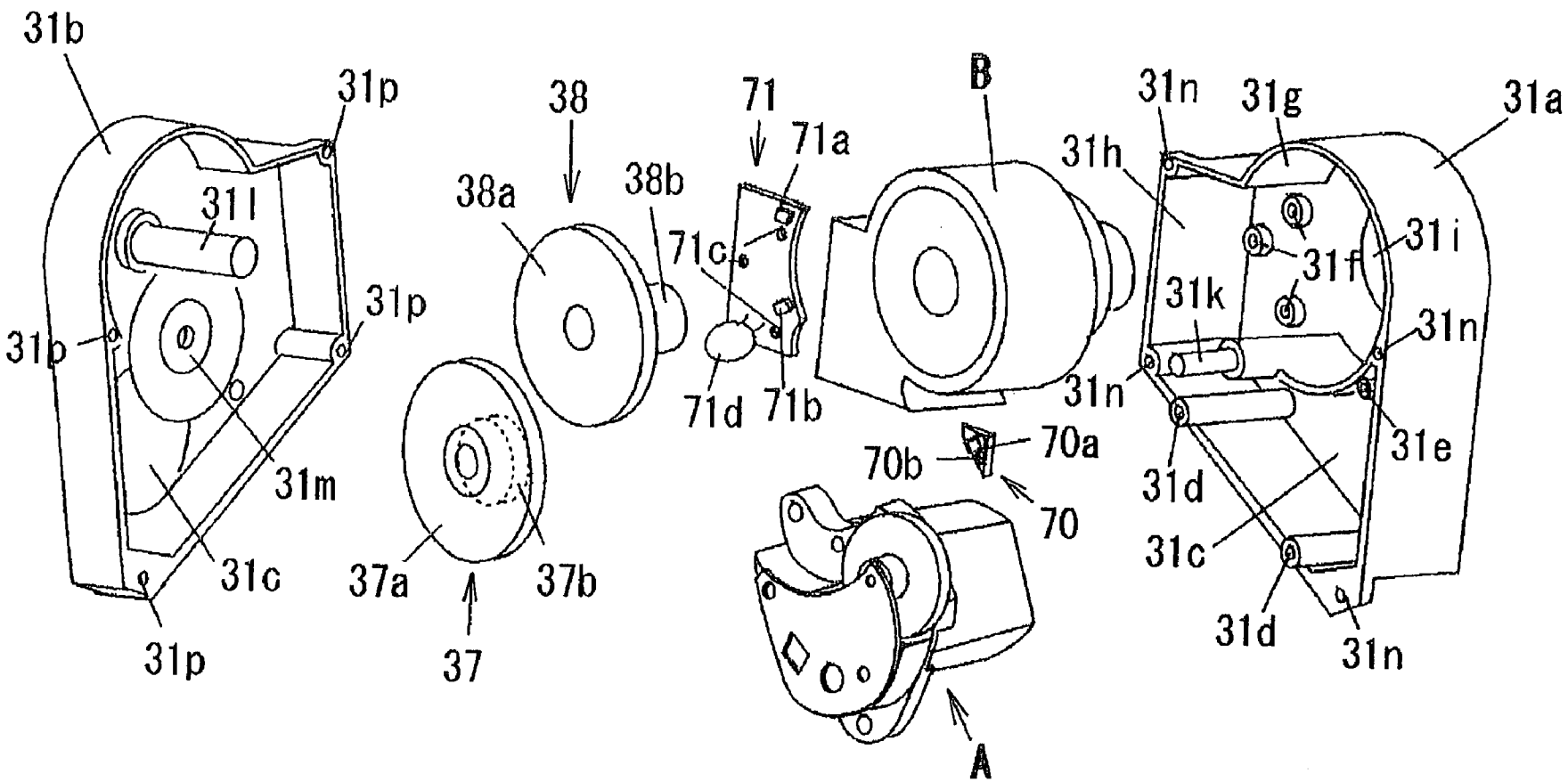
FIG. 25 is an exploded perspective view of the automatic toilet seat lifting and lowering device.
Figure 26:
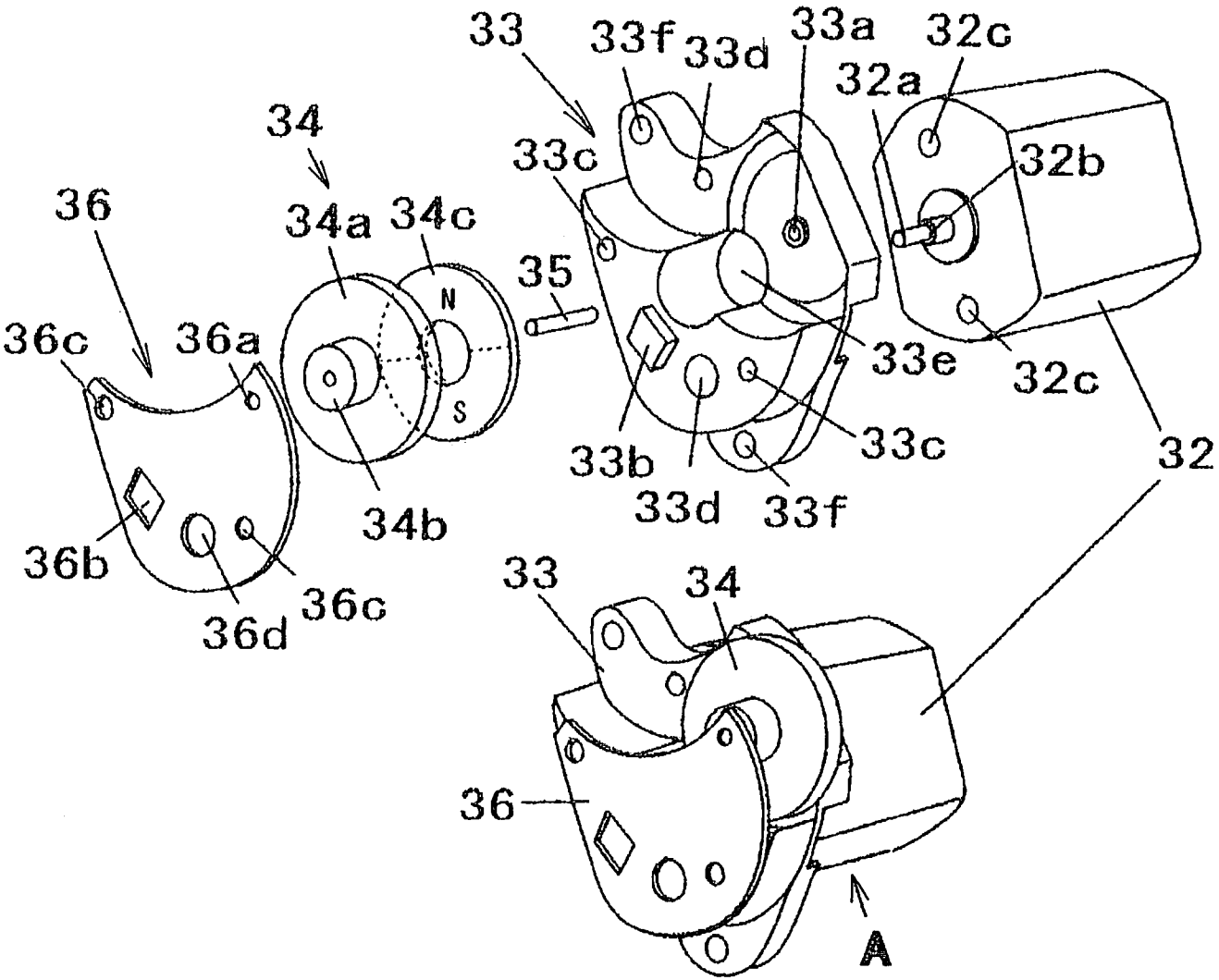
FIG. 26 is an exploded perspective view of a drive motor unit.
Figure 27:
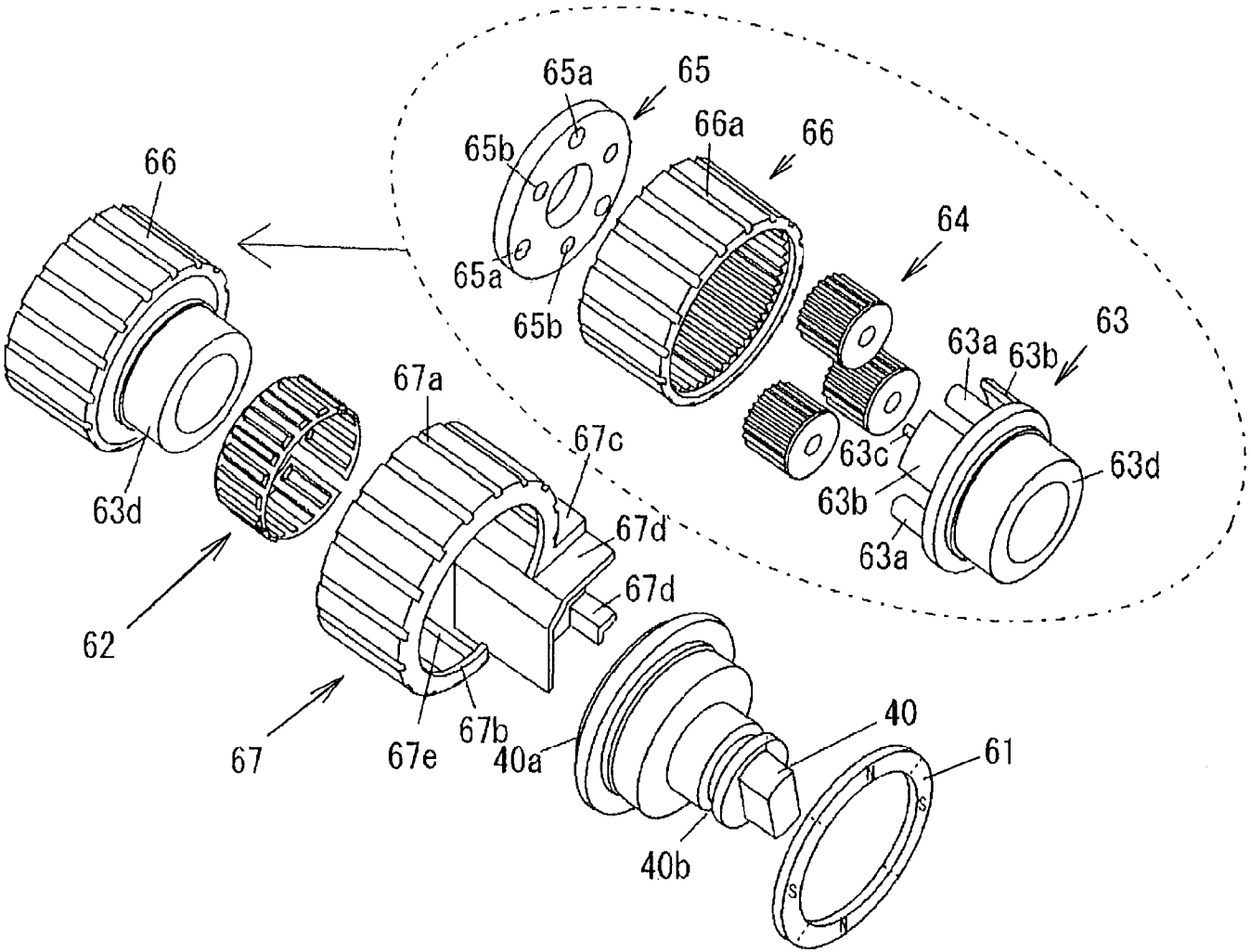
FIG. 27 is an exploded perspective view of a planetary gear unit.
Figure 28:
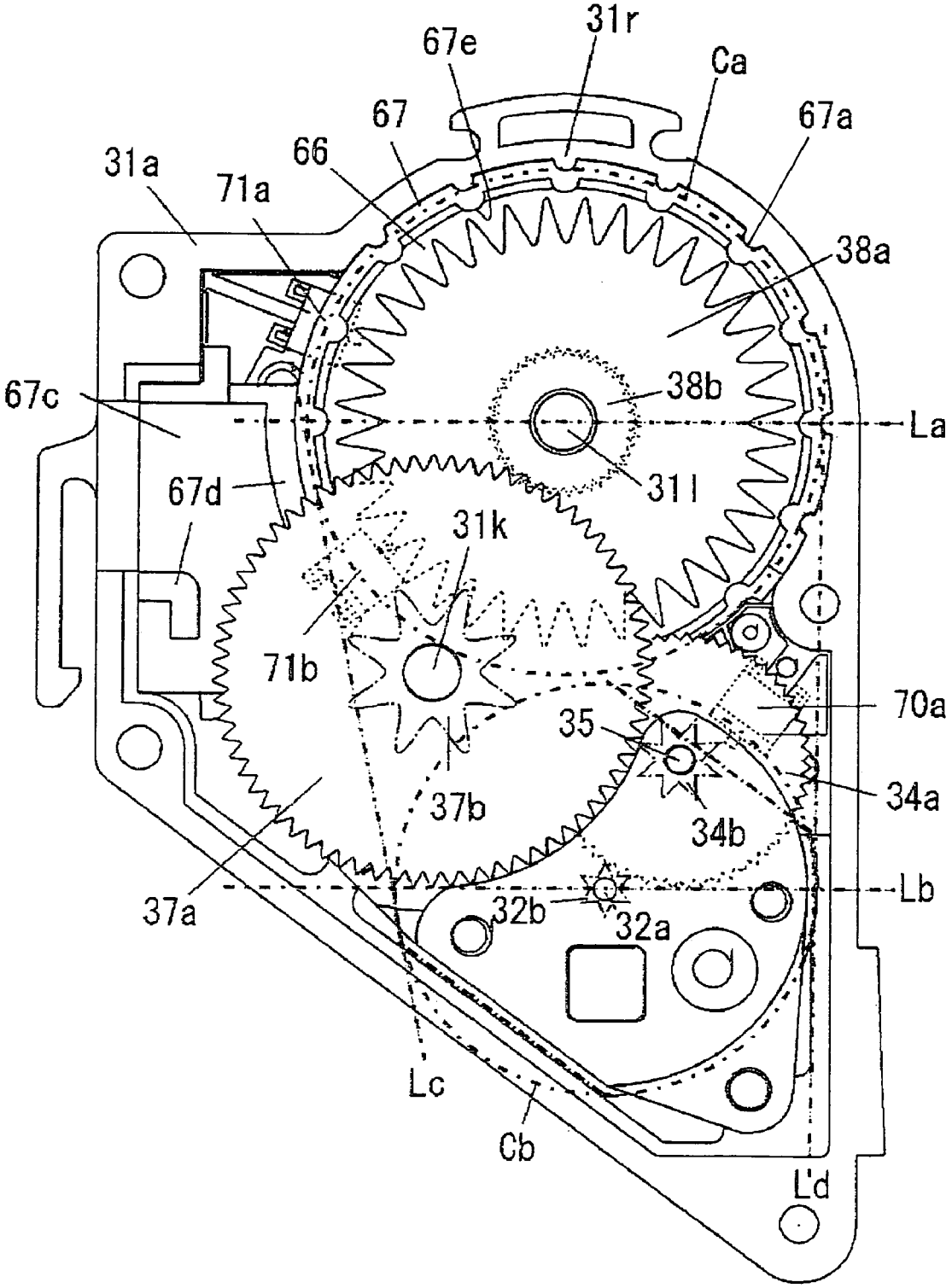
FIG. 28 is a plan view of the automatic toilet seat lifting and lowering device without a casing.
Figure 29:
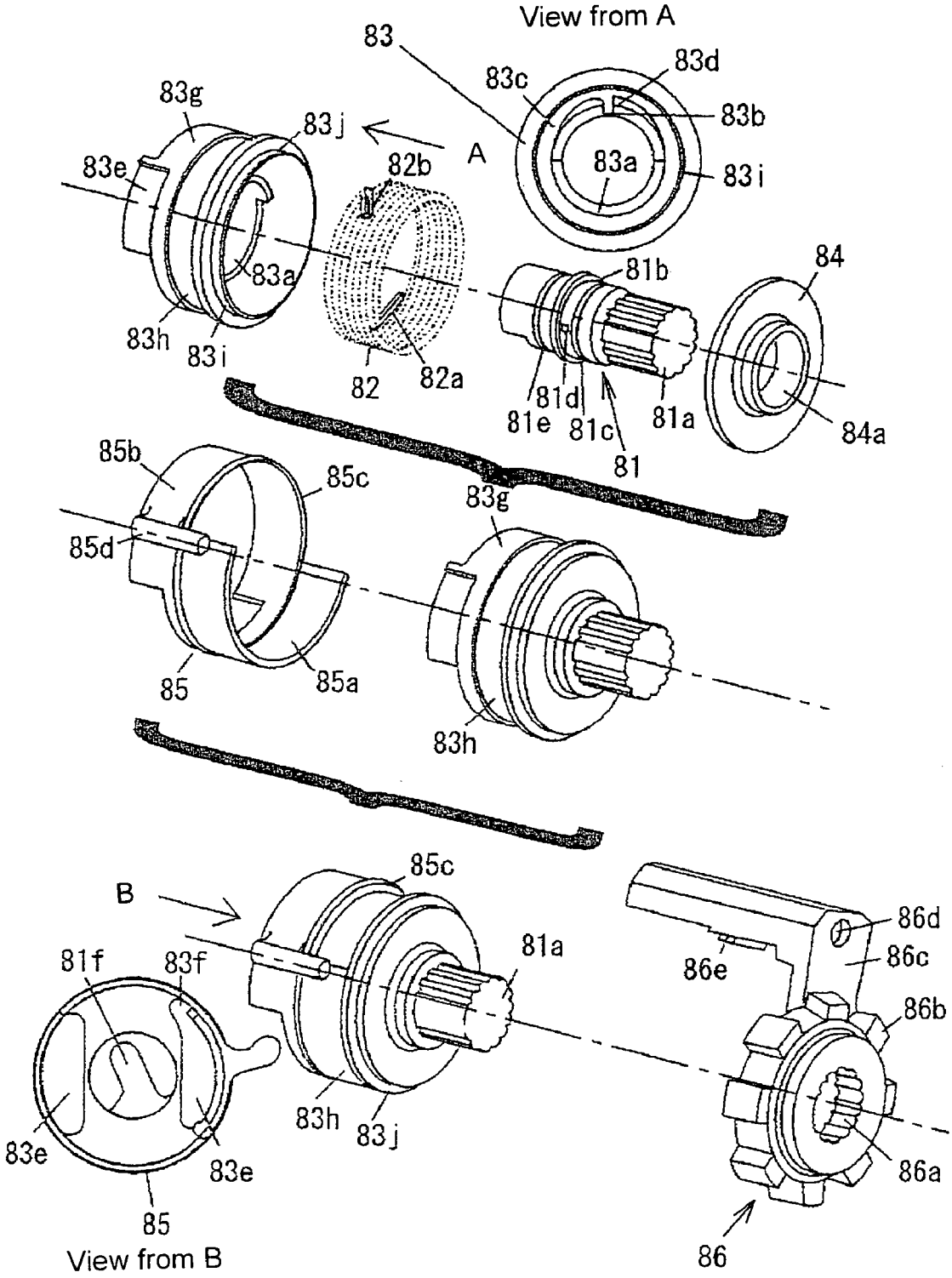
FIG. 29 is an exploded perspective view of an assist unit.

FIG. 25 is an exploded perspective view of the automatic toilet seat lifting and lowering device 30. FIG. 26 is an exploded perspective view of a drive motor unit A. FIG. 27 is an exploded perspective view of a planetary gear unit B. FIG. 28 is a plan view of the automatic toilet seat lifting and lowering device without a casing 31*b*, and FIG. 29 is an exploded perspective view of the assist unit 80. In FIG. 28, the number and shape of cogs of each gear are different from practice (for example, the actual number of the cogs of pinions 32*b* and 34*b* is seven, but there are eight cogs in the drawing).

As shown in FIG. 25, the automatic lifting and lowering device 30 comprises a casing 31 for forming an outer hull (composed of a main case 31*a* and a lid case 31*b*), the drive motor unit A, and the like. The drive motor unit A, as shown in FIG. 26, comprises a drive motor 32, a pinion 32*b*, a spacer 33, a first gear 34, a rotating shaft 35 of the first gear 34, and a bearing 36 of the first gear 34 secured to the spacer 33. The drive motor 32 is composed of a DC brush motor or the like. The pinion 32*b* is press-fitted into an output shaft 32*a* of the drive motor 32. The spacer 33 for fixing the first gear 34 is secured to the drive motor 32 with screws or the like. The first gear 34 has a gearwheel 34*a* engaging with the pinion 32*b*, and a pinion 34*b* for transmitting drive force to the next stage.

A ring-shaped magnet 34*c* is integrated on the surface (on the side of the drive motor) of the gearwheel 34*a* by bonding, caulking or the like. The automatic lifting and lowering device 30 further comprises a second gear 37, a third gear 38, the planetary gear unit B, and the like. The second gear 37 has a gearwheel 37*a* engaging with the pinion 34*b*, and a pinion 37*b* for transmitting drive force to the next stage. The third gear 38 has a gearwheel 38*a* engaging with the pinion 37*b* and a sun gear 38*b* for transmitting drive force to the next stage.

The planetary gear unit B, as shown in FIG. 27, comprises a rotating shaft 40, a ring-shaped magnet 61, a tolerance ring 62, a carrier 63, planetary gears 64, a bearing 65, an internal gear 66, an attachment spacer 67, and the like. The ring-shaped magnet 61 fixed on the rotating shaft 40 detects the rotational position of the toilet seat 12. The tolerance ring 62 functions as a torque limiter so that when a load equal to or more than a set value is applied to the rotating shaft 40, the load is not transmitted to the carrier 63. The carrier 63 is coupled to the rotating shaft 40 through the tolerance ring 62. The planetary gears 64 are rotatably attached to planetary shafts 63*a* provided in the carrier 63. The bearing 65 regulates the movement of the planetary gears 64 in a thrust direction. The internal gear 66 engages with the planetary gears 64. The attachment spacer 67 unrotatably fixes a planetary gear mechanism on the casing 31*a*.

Referring to FIGS. 25 and 26, the pinions 32*b*, 34*b*, and 37*b* are made of metal, and the gearwheels 34*a* and 37*a* are made of resin. The pinion 32*b* and the gearwheel 34*a*, and the pinion 34*b* and the gearwheel 37*a* are helical gears. The gearwheel 38*a* and the sun gear 38*b* of the third gear 38 are integrally made of metal, and the pinion 37*b* and the gearwheel 38*a* are spur gears. Furthermore, the planetary gears 64 shown in FIG. 27 are made of metal, and the internal gear 66 is made of resin. A metal gear is molded by metal sintering such as press sintering, injection sintering, and the like, or by cold forging, and the like. The metal gear is integrally molded with a resin gear by use of insert molding and the like.

A helical gear is thinner than a spur gear, but can secure more contact area. Thus, using the helical gear makes it possible to reduce the thickness of the gear itself while securing the strength of the gear so that the speed reduction gear train is made compact. The helical gears having a large contact area are used in the first and second stages of the speed reduction gear train which rotate at relatively high speed. Thus, backlash is reduced, and hence transmission efficiency is increased.

The occurrence of heat by abrasion, noise and the like can be restrained because metal (pinion) and resin (gearwheel) are engaged in the helical gear. Since the metal gears are used in the third and fourth stages of the speed reduction gear train which rotates at relatively low speed and outputs high torque, it is possible to restrain brakeage of the gears.

Then, a procedure for assembling the automatic lifting and lowering device 30 will be described with reference to FIGS. 26 and 27.

Referring to FIG. 26, assembly of the drive motor unit A is carried out by the following procedure. First, an end of the shaft 35 is inserted into a bearing hole 33*a* of the spacer 33. The first gear 34 is fitted onto the shaft 35, and then the other end of the shaft 35 is inserted into a shaft hole 36*a* of the bearing 36. A positioning boss 33*b* is inserted into a positioning hole 36*b*, and self-tapping screws (not illustrated) are inserted and fixed in fixing holes 36*c*, 36*c*. The self-tapping screws are screwed into bottom holes 33*c* provided in the spacer 33 in order to integrate the spacer 33, the first gear 34, the shaft 35, and the bearing 36.

Then, the output shaft 32*a* and the pinion 32*b* of the drive motor 32 are inserted into a penetration hole 33*e* of the spacer 33 with due attention to the engagement between the first gear 34 and the pinion 32*b*. Screws inserted into a screw insertion hole 36*d* (bearing 36) and a fixing hole 33*d* (spacer 33) are screwed into tapped holes 32*c* provided in the drive motor 32, and then the assembly is completed.

A diameter of the screw insertion hole 36*d* is larger than that of a screw head. A diameter of the fixing hole 33*d* on the side of the screw insertion hole 36*d* is larger than that of the screw head partway (a position where the thickness becomes the same as that of the other fixing hole 33*d*), and becomes small from the middle thereof so that just a screw portion can penetrate. Thus, it is possible to use identical two screws for fixing the spacer 33, the first gear 34, the shaft 35, and the bearing 36 on the drive motor 32.

Since the first stage of the speed reduction gear train is integrated with the drive motor 32, as described above, it is possible to restrain shaft deflection and the like so that transmission efficiency is increased.

Then, a procedure for assembling the planetary gear unit B will be described with reference to FIG. 27. First, the planetary gears 64 are attached to the planetary shafts 63*a* provided in a carrier 63, and the internal gear 66 is attached thereon with due attention to the engagement with the planetary gears 64. Then, end portions of the shafts 63*a* are fitted into bearing recesses 65*a* provided in the bearing 65. A thin cylindrical portion 63*c* of joint spacers 63*b*, which are provided in the carrier 63 to secure an operation area of the planetary gears 64, is inserted into a penetration hole 65*b* provided in the bearing 65 and caulked so that the carrier 63, the planetary gears 64, the bearing 65, and the internal gear 66 are integrated (what is integrated is hereinafter referred to as "a planetary gear mechanism").

The tolerance ring 62 is fitted on the outer periphery of an output shaft 63*d* of the planetary gear mechanism. The spacer 67 having a plurality of protruding portions 67*e* (refer to FIG. 28), the shape of which is approximately the same as a recessed groove 66*a* formed on the outer periphery of the internal gear 66 at regular intervals to prevent rotation, is fitted on the internal gear 66. Then, the outer periphery of the tolerance ring 62 is fitted into a coupling hole 40*a* provided in a rear end of the rotating shaft 40 in a state where the output shaft 63*d* protrudes from an aperture 67*b* of the spacer 67 so that assembly of the planetary gear unit B is completed.

The ring-shaped magnet 61 (having two pairs of the north pole and the south pole) is integrated into a flange 40*b* of the rotating shaft 40 in advance by use of a snap ring or the like. A protection block 67*c* for protecting an area detection circuit 71 described later is integrally provided on a back side of the spacer 67, and a rib 67*d* for wiring management is provided on the surface of the protection block 67*c*.

The procedure for assembling the automatic lifting and lowering device 30 will be described with reference to FIG. 25. A self-tapping screw (not illustrated) is inserted into an attachment hole 70*b* of the rotation detection circuit 70, in which a Hall integrated circuit 70*a* for detecting magnetic force of the magnet 34*c* is mounted. The self-tapping screw is screwed into a bottom hole 31*e* of an attachment boss provided in the casing 31*a* so that the rotation detection circuit 70 is integrated into the casing 31*a*.

Then, self-tapping screws (not illustrated) are inserted into attachment holes 71*c* of the area detection circuit 71, in which Hall integrated circuits 71*a* and 71*b* for detecting magnetic force of the magnet 61 are mounted. The self-tapping screws are screwed into bottom holes 31*f* of attachment bosses provided in the casing 31*a* so that the area detection circuit 71 is integrated into the casing 31*a*. Wires (not illustrated) for carrying current to the drive motor 32 are soldered to the area detection circuit 71, and a positive-characteristic thermistor 71*d* which is connected to one of the wires in series is further soldered thereto. The positive-characteristic thermistor is provided to prevent overcurrent from flowing into the drive motor 32.

Then, the drive motor unit A is contained in a motor container portion 31*c* provided in a lower end portion of the casing 31*a*, and self-tapping screws (not illustrated) are inserted into attachment holes 33*f* formed in the spacer 33. The self-tapping screws are screwed in bottom holes 31*d* of attachment bosses provided in the casing 31*a* so that the drive motor unit A is integrated with the casing 31*a*.

Then, the planetary gear unit B is inserted and fixed into a cylindrical portion 31*g* of the casing 31*a* in such a manner that protrusions 31*r* (refer to FIG. 28) provided in the cylindrical portion 31*g* of the casing 31*a* are fitted into recessed grooves 67*a* formed on the outer periphery of the spacer 67, and the outside shape of the protection block 67*c* of the spacer 67 makes contact with the inner wall of the casing 31*a*. A penetration hole 311 is formed in a back wall of the cylindrical portion 31*g*, and an O-ring 40*c*, which is fitted into an O-ring groove 40 provided in a peripheral wall 31*j* of the penetration hole 31*i* and the rotating shaft 40, prevents water from entering from the penetration hole 31*i*.

Since the planetary gear mechanism itself needs to be a perfect circle due to its functional reason, when the planetary gear mechanism is directly attached to the casing 31*a*, the cylindrical portion 31*g* of the casing 31*a* also needs to be a perfect circle. Thus, dimensional tolerance becomes severe, and hence manufacturing yield decreases. This is a reason why the casing 31*a* is installed by use of the spacer 67. In the present invention, since the spacer 67 and the casing 31*a* are simply in contact with each other at points of the protruding portions 67*e* of the spacer 67 and the protrusions 31*r* of the casing 31*a*, manufacturing tolerance is absorbed by elastic deformation of the spacer 67. Therefore, it is possible to easily manufacture the cylindrical portion 31*g* of the casing 31*a*.

Then, the third gear 38 is inserted into the planetary gear mechanism with due attention to the engagement between the planetary gears 64 and the sun gear 38*b*. The second gear 37 is inserted into and fixed to a shaft 31*k* with due attention to the engagement between the pinion 37*b* and the gearwheel 38*a* and between the gearwheel 37*a* and the pinion 34*b*.

Lastly, a shaft 31*l* provided in the casing 31*b* is inserted into a shaft hole 38*c* of the third gear 38, and an end of the shaft 31*k* is inserted into a bearing 31*m*. Self-tapping screws, inserted into attachment holes 31*n* provided in the casing 31*a*, are screwed into bottom holes 31*p* of the attachment bosses provided in the casing 31*b* so that assembly of the automatic toilet seat lifting and lowering device 30 is completed.

The drive motor 32 and the planetary gear mechanism, as shown in FIG. 28, are disposed in such a manner that two circles (Ca and Cb) formed on a plane of projection of the outside shape of the drive motor 32 and the outside shape of the planetary gear mechanism are adjacent to each other, and that the shafts of the first gear 34 and the second gear 37 are disposed inside an area surrounded by the two circles (Ca and Cb) and lines (Lc and Ld) circumscribing the two circles on a plane of projection. Therefore, it is possible to design the automatic lifting and lowering device 30 in a compact manner.

Furthermore, in this embodiment, since the shafts of the first gear 34 and the second gear 37 are disposed inside an area surrounded by horizontal lines (La and Lb), which pass through the centers of the two circles (Ca and Cb), and the circumscribed lines (Lc and Ld) on a plane of projection, it is possible to design the automatic lifting and lowering device 30 in a more compact manner. A line, which is vertical with respect to a line connecting the centers of the two circles (Ca and Cb) and passes through the center of each circle, may be used instead of the horizontal lines (La and Lb). There is not much difference between using the horizontal lines and using the vertical lines because the vertical lines also become approximately parallel in this embodiment. However, when, the speed reduction gear train is horizontally disposed, for example, it is preferable to use the vertical lines.

Next, the automatic toilet cover lifting and lowering device 130 will be described. Because the automatic toilet cover lifting and lowering device 130 has similar components and a similar assembly procedure to those of the automatic toilet seat lifting and lowering device 30, the description thereof is omitted exclusive of the following differences.

The components of the automatic toilet cover lifting and lowering device 130 are symmetrical to those of the automatic toilet seat lifting and lowering device 30. As shown in FIGS. 22, 24, and 28, the output shaft 140 of the automatic toilet cover lifting and lowering device 130 is provided with an approximately rectangular coupling hole 141, into which the rotating shaft 50 is unrotatably inserted and fixed. A casing 131*a* of the automatic toilet seat lifting and lowering device 130 is integrally provided with a boss 131*b* for keeping a predetermined space from a sidewall 11*b* of the casing 11, and a bearing projection 131*c* for bearing a cap member 11*d*.

Next, the assist unit 80 will be described with the use of FIGS. 23 and 29. The assist unit 80 comprises the coupling shaft 81, an assist spring 82, a coupling cover 83, a lid cover 84, an attachment lever 85, a fixing member 86, and the like. The coupling shaft 81 is unrotatably coupled to the rotating shaft 40 of the automatic lifting and lowering device 30. One end 82*a* of the assist spring 82 is fixed on the coupling shaft 81 to bias the toilet seat 12 in the lifting direction. The other end 82*b* of the assist spring 82 is fixed on the coupling cover 83, which is unrotatably coupled to the casing 11. The lid cover 84 covers the assist spring 82 together with the coupling cover 83. The attachment lever 85 attaches/detaches the toilet seat 12 to/from the casing 11. The fixing member 86 fixes the assist unit 80 on the toilet seat 12.

Serrations are formed in an end portion 81*a* of the coupling shaft 81 (a support shaft of the toilet cover 13). A large diameter portion 81*b* is provided in the approximately middle of the coupling shaft 81 to regulate the movement of the coupling shaft 81 in the thrust direction. The coupling shaft 81 is provided with an O-ring groove 81*c* to seal the clearance between the coupling shaft 81 and an inner cylindrical portion 84*a* of the lid cover 84. An insertion hole 81*d* is formed between the large diameter portion 81*b* and the O-ring groove 81*c* so that one end of the coupling shaft 81 is inserted into the assist spring 82. The coupling shaft 81 is further provided with an O-ring groove 81*e* to seal the clearance between the coupling shaft 81 and an inner cylindrical portion 83*a* of the cover 83. A groove 81*f*, which takes approximately the same shape as the outside shape of the rotating shaft 40, is formed in a rear end portion of the coupling shaft 81.

One end 82*a* of the assist spring 82, which is folded toward the center, is inserted into the insertion hole 81*d*. The other end 82*b* of the assist spring 82 folded toward the center is fixed in a support groove 83*b*, which is formed on the outer periphery of the inner cylindrical portion 83*a* of the coupling cover 83. The thickness of a bottom portion 83*c* is slightly increased in the basal portion of the support groove 83*b* in order to form a prevention wall 83*d* which prevents the other end 82*b* of the assist spring 82 from rotating.

Regulating protrusions 83*e* are formed in a rear end of the coupling cover 83. The regulating protrusions 83*e* are fitted into engaging protrusions 31*q*, which are integrally formed in an outer casing 31*a* of the automatic toilet seat lifting and lowering device 30 to regulate the rotation of the coupling cover 83. A stopper 83*f* for regulating the rotation of the attachment lever 85 is formed in a part of a peripheral edge of the regulating protrusion 83*e*. A thin portion 83*h*, the diameter of which is slightly made small, is formed in an outer cylindrical portion 83*g*. A rib 83*i* for welding is formed on the whole periphery of an open end of the coupling cover 83, and the lid cover 84 is integrated by ultrasonic welding or the like.

The attachment lever 85 comprises a support cylinder 85*a* with the upper half thereof cut out, an attachment cylinder 85*b* with the lower half thereof cut out, and a ring-shaped rib 85*c* disposed between the support cylinder 85*a* and the attachment cylinder 85*b*. The thickness of the rib 85*c* is slightly increased on the inside and the outside. The internal diameter of the ring-shaped rib 85*c* is approximately the same as that of the thin portion 83*h*, and is smaller than that of the outer cylindrical portion 83*g*. A protrusion 85*d* for grasp is formed in the attachment cylinder 85*b*.

An opening 86*a* for coupling, projections 86*b*, and an approximately L-shaped coupling crank 86*c* are formed in the fixing member 86. The opening 86*a* takes approximately the same shape as the outside shape of the coupling shaft 81. The projections 86*b* are provided at regular intervals on the outer periphery of the fixing member 86 in order to unrotatably fix the fixing member 86 on the toilet seat 12. A bottom hole 86*d* for a joint screw, and a stopper 86*e* for regulating the movement of the assist unit 80 (exclusive of the fixing member 86) in the thrust direction are formed in the coupling crank 86*c*.

A procedure for assembling the assist unit 80 will be described with reference to FIG. 29. O-rings are fitted into the O-ring grooves 81*c* and 81*e* of the coupling shaft 81. One end 82*a* of the assist spring 82 is inserted into the insertion hole 81*d* of the coupling shaft 81. The other end 82*b* of the assist spring 82 is engaged in the support groove 83*b* of the coupling cover 83, and the coupling shaft 81 is inserted into the inner cylindrical portion 83*a* of the coupling cover 83 until an end portion of the inner cylindrical portion 83*a* makes contact with the large diameter portion 81*b* of the coupling shaft 81. Thus, the end 82*b* of the assist spring 82 is contained in the prevention wall 83*d*.

Then, the end portion 81*a* of the coupling shaft 81 is inserted into the inner cylindrical portion 84*a* of the lid cover 84. While a rear side of the lid cover 84 makes contact with the rib for welding 83*i* of the coupling cover 83, the coupling shaft 81, the assist spring 82, the coupling cover 83, and the lid cover 84 are integrated by ultrasonically vibrating the lid cover.

Then, the attachment lever 85 is inserted into the outer cylindrical portion 83*g*. The outer cylindrical portion 83*g*, however, has a slightly larger diameter than the ring-shaped rib 85*c* so that, when the ring-shaped rib 85*c* getting on the outer cylindrical portion 83*g* is fitted onto the thin portion 83*h*, the coupling cover 83 and the attachment lever 85 are integrated. The outer cylindrical portion 83*g* and the ring-shaped rib 85*c* prevent the attachment lever 85 from falling off in the thrust direction. Then, by inserting the coupling shaft 81 into the opening for coupling 86*a* of the fixing member 86, the assist unit 80 is integrated.

The coupling shaft 81 of the assist unit 80 is inserted into a coupling hole 12*d* (refer to FIG. 21) of the toilet seat 12, and the assist unit 80 is inserted into the coupling portion 12*a* of the toilet seat 12. In this state, a self-tapping screw is screwed into the bottom hole 86*d* of the fixing member 86 and a tapped hole 12*c* (refer to FIG. 21) of the toilet seat 12 in order to integrate the toilet seat 12 and the assist unit 80.

Since the coupling crank 86*c* is elastically deformable to the outside before being attached to the toilet seat 12, the assist unit 80 (except for the fixing member 86) is attachable to and detachable from the fixing member 86. After the attachment to the toilet seat 12, however, the toilet seat 12 regulates the deformation to the outside, and hence the stopper 86*e* and the flange 83*j* of the coupling cover 83 prevent the assist unit 80 (except for the fixing member 86) from falling off in the thrust direction.

Likewise, the attachment lever 85 is prevented from falling off in the thrust direction because the attachment lever 85 cannot be deformed outside in such a degree as to surmount the outer cylindrical portion 83*g* due to small clearance between the coupling crank 86*c* and the outer cylindrical portion 83*g*.

Figure 30:
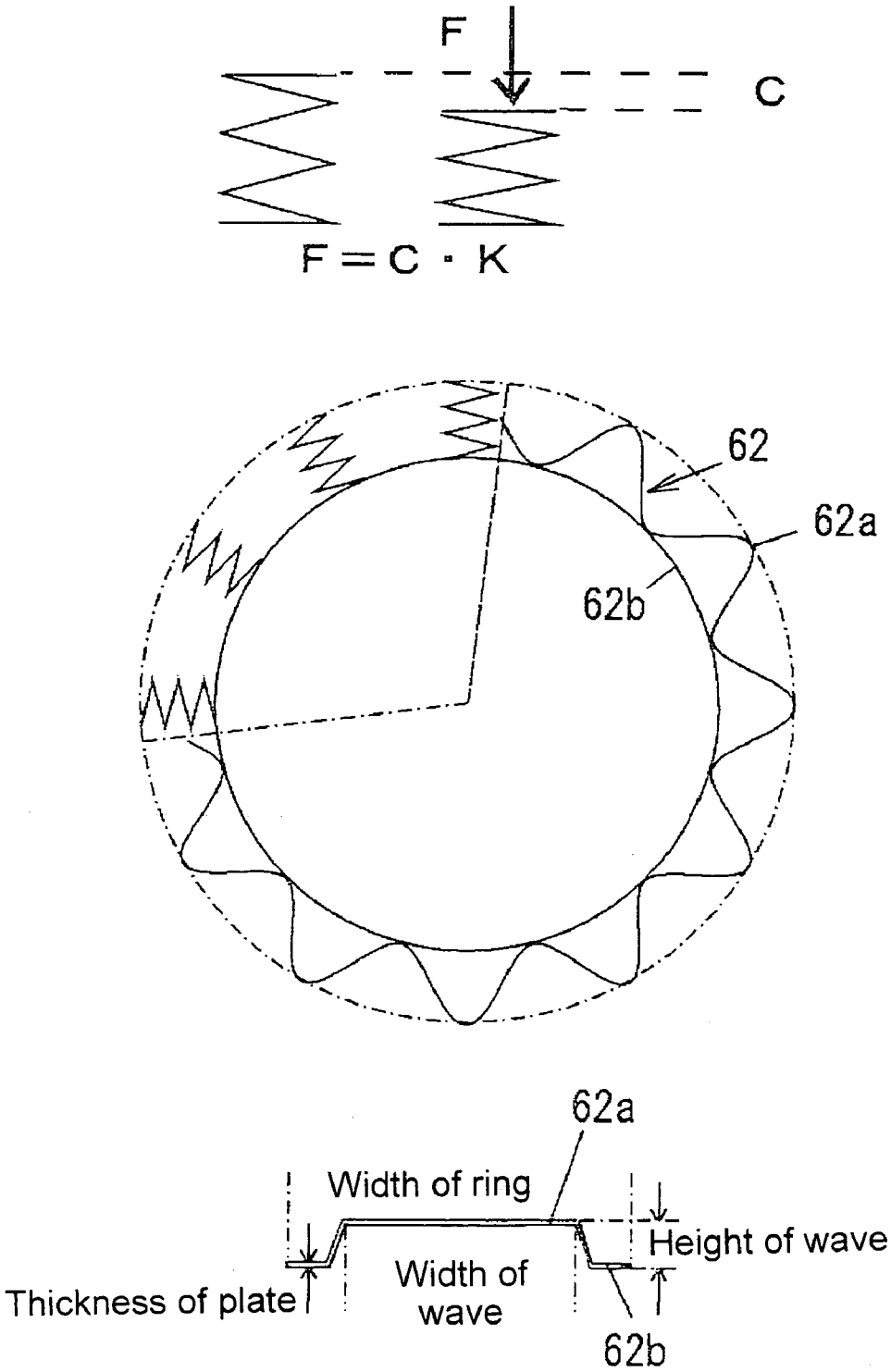
FIG. 30 is a principle diagram of a tolerance ring.

The tolerance ring 62 will be described with the use of a principle diagram shown in FIG. 30. The tolerance ring 62, as shown in FIG. 30, takes the shape of a ring with wave-shaped portions. Each wave functions as a spring, and its functional force is proportional to an amount of deformation of the wave. The following equations are satisfied:

$$RL=n\cdot c\cdot K$$

$$AF=RL\cdot\mu$$

$$Mt=AF\cdot d/2$$

wherein, AF represents force necessary for assembly, RL (N) represents force in a radial direction, μ represents a coefficient of friction, n represents the number of the waver, c (mm) represents an amount of deformation of the wave, K (N/mm) represents a rate of spring, Mt represents transmitted torque, and d (m) represents the diameter of a shaft.

The spring constant is variable in accordance with the thickness of material and the pitch, width, shape, and height of the wave. Thus, maximum torque applied to the rotating shafts 40 and 140 in a normal state is estimated by experiments and the like, and the shape of the tolerance ring 62 is selected in accordance with the maximum torque.

When torque equal to or more than the maximum torque is applied to the rotating shaft 40, wave-shaped portions 62*a* of the tolerance ring 62 are engaged and fixed in the coupling holes of the rotating shafts 40 and 140. A ring-shaped edge portion 62*b* of the tolerance ring slips on the outer periphery of the output shaft 63*d* of the carrier 63 so that an excessive load equal to or more than the set torque is not applied to the inside of the automatic lifting and lowering devices 30 and 130. Therefore, it is possible to prevent the damage and the like of the gears.

Figure 31:
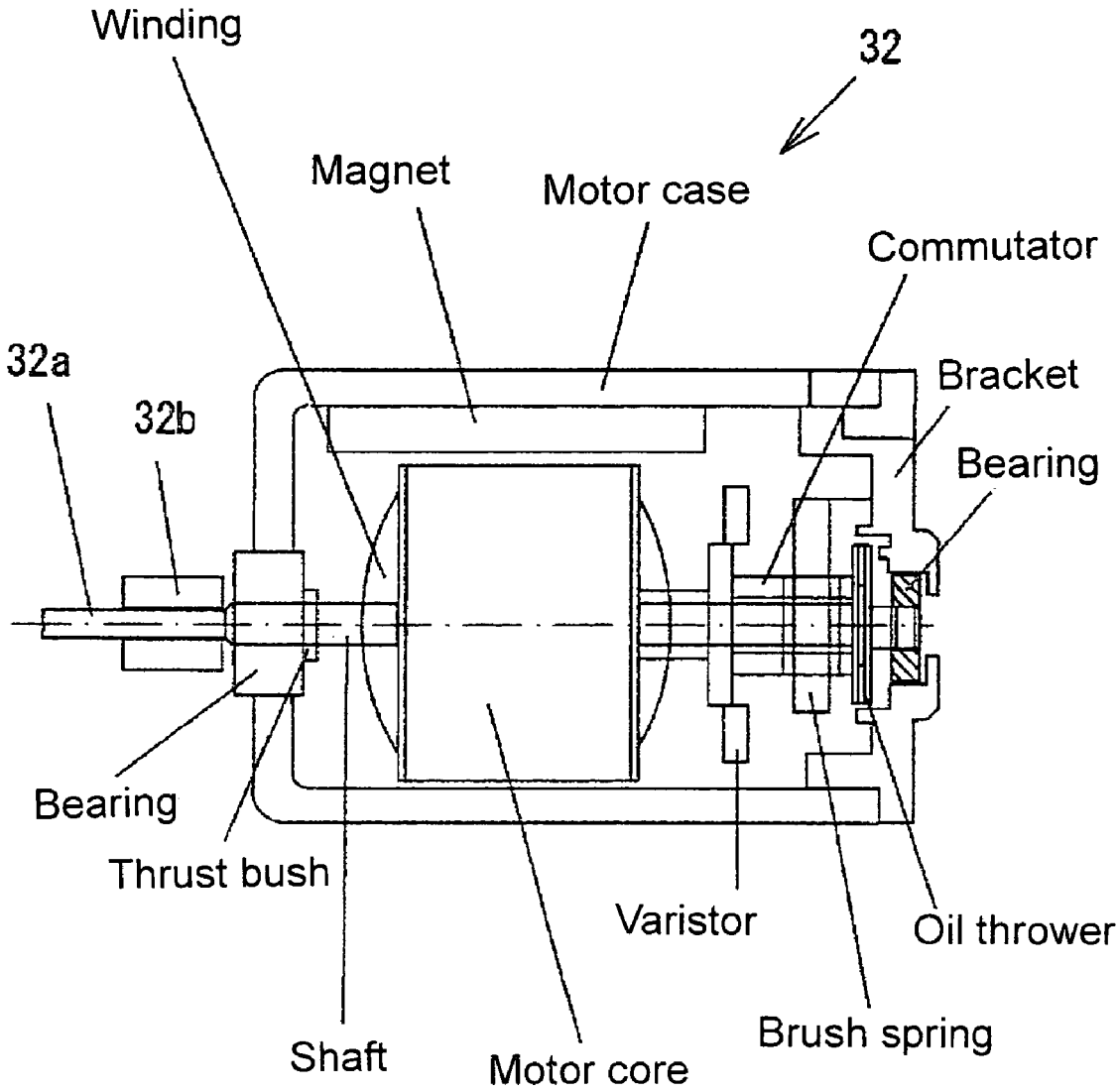
FIG. 31 is a sectional view of a drive motor.

The shaft of the drive motor 32, as shown in FIG. 31, penetrates the inside of the motor, and the diameter of the shaft is relatively large in the inside but small in an exposed portion. The reason why the diameter is small in an end portion 32*a* is to reduce the number of cogs of the pinion 32*b* and increase a speed reducing ratio. Although it may be considered that the whole shaft has a small diameter, the shaft deflection of the drive motor 32 is increased when the shaft is thin with respect to the length thereof. Therefore, the whole shaft does not have the small diameter, but only a part to which the pinion 32*b* is attached has the small diameter.

Then, the operation of the toilet seat apparatus 10 having the foregoing structure will be described.

Figure 32:
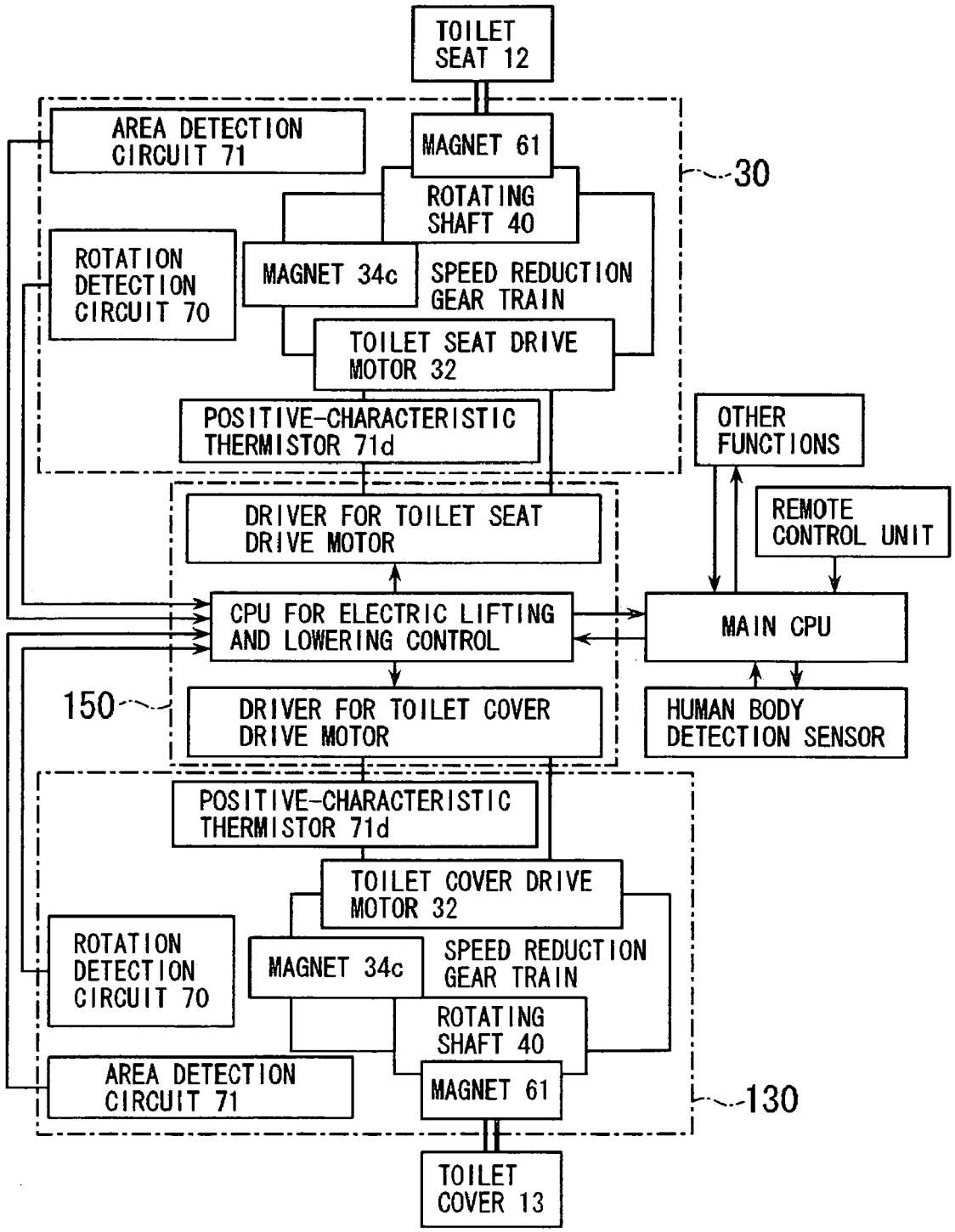
FIG. 32 is a control block diagram of the toilet seat apparatus according to the present invention.

FIG. 32 is a control block diagram of the toilet seat apparatus according to the present invention. When a human body detection sensor detects the existence of a human body, or a toilet cover lifting switch (not illustrated) provided in a remote control unit or the like is operated, current flows into the drive motor 32 in the automatic toilet cover lifting and lowering device 130. The rotation of the drive motor 32 is transmitted to the rotating shaft 50 through the speed reduction gear train (the pinion 32*b*, the first gear 34, the second gear 37, the third gear 38, and the planetary gear mechanism), the tolerance ring 62, and the output shaft 140 in order to lift the toilet cover 13.

The magnet 61 and the two Hall integrated circuits 71*a* and 71*b* provided in the area detection circuit 71 detect that which area the toilet cover 13 belongs, among a lowered area (equal to or less than 20 degrees), a rotating area (equal to or more than 20 degrees and less than 80 degrees), a lifted area (equal to or more than 80 degrees and less than 110 degrees), and an abnormal area (equal to or more than 110 degrees). Energization control (or short control) to the drive motor 32 is carried out in accordance with each area. Furthermore, the magnet 34*c* and the Hall integrated circuit

70*a* provided in the rotation detection circuit 70 detect the rotation of the drive motor 32 to detect the position of the toilet cover 13 in each area with relative precision. Therefore, it is possible to carry out the energization control more precisely.

Upon operating a toilet seat lifting switch provided in the remote control unit or the like, current flows into the drive motor 32 in the automatic toilet seat lifting and lowering device 30. The rotation of the drive motor 32 is transmitted to the rotating shaft 40 through the speed reduction gear train (the pinion 32*b*, the first gear 34, the second gear 37, the third gear 38, and the planetary gear mechanism) and the tolerance ring 62 so as to lift the toilet seat 12.

As in the case of the automatic toilet cover lifting and lowering device 130, the rotation detection circuit 70 and the area detection circuit 71 detect the position of the toilet seat 12 to carry out the energization control (or short control) of the drive motor 32 in accordance with the position.

Since the heater for heating the seat is installed in the toilet seat 12, the toilet seat 12 is relatively heavy. Thus, the automatic toilet seat lifting and lowering device 30, which has the same structure as the automatic toilet cover lifting and lowering device 130, is not enough to lift up the toilet seat 12. Therefore, the assist unit 80 is provided. The assist unit 80 contains the assist spring 82 having one end integrated into the casing 11 and the other end integrated into the toilet seat 12. This assist spring 82 has natural length when the toilet seat 12 is approximately vertical. The assist spring 82 is warped when the toilet seat 12 is lowered.

Therefore, when the toilet seat 12 is lowered, torque on the lifting side can be generated. By this structure, the automatic toilet seat lifting and lowering device 30 can lift up the toilet seat 12 even if the automatic toilet seat lifting and lowering device 30 has the same structure as the automatic toilet cover lifting and lowering device 130.

One end 82*a* of the assist spring 82 is integrated into the casing 11 by the engagement between the regulating protrusions 83*e* of the coupling case 83 and the engaging protrusions 31*q* of the automatic toilet seat lifting and lowering device 30 attached to the casing 11. The other end 82*b* of the assist spring 82 is integrated into the toilet seat 12 through the coupling shaft 81 and the fixing member 86.

Upon operating a toilet seat lowering switch (not illustrated) provided in the remote control unit or the like, the drive motor 32 is energized in an opposite direction to the lifting operation, and energization control (or short control) is carried out in accordance with the position of the toilet seat 12, which is detected by the rotation detection circuit 70 and the area detection circuit 71.

When the human body detection sensor (not illustrated) detects the departure of a human body, or a toilet cover lowering switch (not illustrated) provided in the remote control unit or the like is operated, as in the case of the toilet seat 12, the automatic toilet cover lifting and lowering device 130 is controlled to lower the toilet seat 13.

INDUSTRIAL APPLICABILITY

The automatic lifting and lowering device for the toilet seat or the toilet cover according to the present invention, as described above, is used as an automatic toilet seat or toilet cover lifting and lowering device in a Western-style toilet.

The automatic lifting and lowering device according to the present invention can reduce an attachment area of the whole device. Thus, other functional parts are installable below the rotating shaft of the toilet seat or the toilet cover so that the automatic lifting and lowering device is effectively used in a toilet seat with a function of washing a body with hot water or the like, which is required to be light in weight and compact.

The invention claimed is:

1. An automatic toilet seat or toilet cover lifting and lowering device comprising:

a rotating shaft that is rotatable together with a toilet seat or a toilet cover;

a drive motor for rotating the rotating shaft in normal and reverse directions; and a speed reduction gear train having a plurality of gears arranged in a sequence beginning at said motor so as to transmit a drive force of said motor to said rotating shaft through said speed reduction gear train to lift and lower the toilet seat or the toilet cover, wherein a final stage of the plurality of gears comprises a planetary gear mechanism, the final stage of the plurality of gears being the end of the sequence of the plurality of gears.

2. The automatic toilet seat or toilet cover lifting and lowering device according to claim 1, wherein said planetary gear mechanism and the drive motor are adjacently disposed in such a manner that an input end face of the planetary gear mechanism and an output end face of the drive motor are approximately coplanar, and the center of the shaft of the remaining speed reduction gear train is disposed inside an area that is surrounded by two circles formed on a plane of projection of said planetary gear mechanism and said drive motor and inside lines circumscribing the two circles.

3. The automatic toilet seat or toilet cover lifting and lowering device according to claim 2, wherein the center of the shaft of the remaining speed reduction gear train is disposed in an area that is surrounded by a horizontal line passing through the center of a sun gear of said planetary gear mechanism and the lines circumscribing said two circles.

4. The automatic toilet seat or toilet cover lifting and lowering device according to claim 2, wherein the center of the shaft of the remaining speed reduction gear train is disposed in an area that is surrounded by perpendicular lines which are perpendicular to a line connecting the center of a sun gear of said planetary gear mechanism and the center of the output shaft of said drive motor and pass through the centers thereof, and the lines circumscribing said two circles.

* * * * *